US011040805B2

(12) United States Patent
Jelich

(10) Patent No.: US 11,040,805 B2
(45) Date of Patent: Jun. 22, 2021

(54) CLOSURE FOR A CONTAINER

(71) Applicant: AptarGroup, Inc., Crystal Lake, IL (US)

(72) Inventor: Nicholas Jelich, Oconomowoc, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 196 days.

(21) Appl. No.: 16/331,216

(22) PCT Filed: Sep. 13, 2018

(86) PCT No.: PCT/US2018/050845
§ 371 (c)(1),
(2) Date: Mar. 7, 2019

(87) PCT Pub. No.: WO2020/055407
PCT Pub. Date: Mar. 19, 2020

(65) Prior Publication Data
US 2020/0399030 A1 Dec. 24, 2020

(51) Int. Cl.
*B65D 47/08* (2006.01)
*B65D 50/04* (2006.01)

(52) U.S. Cl.
CPC ..... *B65D 47/0809* (2013.01); *B65D 50/046* (2013.01); *B65D 47/0838* (2013.01);
(Continued)

(58) Field of Classification Search
CPC ..... B65D 47/0809; B65D 50/046; B65D 47/0838; B65D 2251/105; B65D 2251/1058; B65D 2543/00296
See application file for complete search history.

(56) References Cited

U.S. PATENT DOCUMENTS 4,022,352 A 5/1977 Pehr
4,170,315 A * 10/1979 Dubach ..... B65D 47/0838 220/281

(Continued)

OTHER PUBLICATIONS

International Search Report and Written Opinion from the U.S. acting as International Searching Authority for PCT/US18/50845 of which this subject application is a U.S. National Stage. Box No. V indicates that PCT claims 4, 9-11, and 19 possess novelty, inventive step, and industrial applicability.

*Primary Examiner* — James N Smalley
(74) *Attorney, Agent, or Firm* — Wood, Phillips, Katz, Clark & Mortimer

(57) ABSTRACT

A closure (40) includes a closure body (54) defining a first latch portion (60) and a lid (56) connected to the body (54) movable between (i) a closed position, and (ii) an open position. The lid includes a flexible, recessed press portion (58) defining a second latch portion (64). The closure body (54) and the lid (56) have (i) a latched configuration with the lid (56) in the closed position wherein the first latch portion (60) and the second latch portion (64) are oriented in a confronting relationship to prevent the lid (56) from moving into its open position, and (ii) an unlatched configuration with the lid (56) in the closed position wherein the recessed press portion (58) is deflected inwardly to move the second latch portion (64) out of the confronting relationship with the first latch portion (60) to permit the lid (56) to move from its closed position.

4 Claims, 20 Drawing Sheets

(52) U.S. Cl.
CPC ..... *B65D 2251/105* (2013.01); *B65D 2251/1058* (2013.01); *B65D 2543/00296* (2013.01)

(56) References Cited

U.S. PATENT DOCUMENTS

| | | | | | |
|---|---|---|---|---|---|
| 4,244,495 | A * | 1/1981 | Lorscheid | B65D 47/0819 | 222/153.14 |
| 4,892,208 | A * | 1/1990 | Sledge | B65D 47/0819 | 215/216 |
| 5,353,946 | A * | 10/1994 | Behrend | B65D 43/169 | 220/326 |
| 5,579,957 | A * | 12/1996 | Gentile | B65D 47/0814 | 215/237 |
| 6,772,902 | B1 * | 8/2004 | White | B65D 43/162 | 215/201 |
| 7,861,873 | B1 | 1/2011 | Bragg et al. | | |
| 8,596,493 | B2 | 12/2013 | Vollers et al. | | |
| 2002/0175137 | A1 * | 11/2002 | Rousselet | B65D 47/0838 | 215/235 |
| 2003/0111495 | A1 | 6/2003 | Parve et al. | | |
| 2003/0201283 | A1 | 10/2003 | Branson et al. | | |
| 2006/0086757 | A1 * | 4/2006 | Robinson | B65D 50/046 | 222/153.14 |
| 2010/0170910 | A1 * | 7/2010 | Ludewigs | B65D 47/0838 | 220/810 |
| 2012/0273523 | A1 | 11/2012 | Walter et al. | | |
| 2018/0305093 | A1 * | 10/2018 | Lucas, Jr. | B65D 43/162 | |

* cited by examiner

CLOSURE FOR A CONTAINER

TECHNICAL FIELD

The present invention relates generally to a closure for a container of a substance.

BACKGROUND OF THE INVENTION AND TECHNICAL PROBLEMS POSED BY THE PRIOR ART

Closures are employed to selectively prevent or permit communication between the exterior and interior of a container (e.g., bottle, flexible pouch, machine, vessel, etc.) through an opening in the container. A typical closure includes at least (1) a receiving structure (e.g., a body, base, fitment, etc.) arranged at an opening to the container interior, and (2) a closing element (e.g., a lid, cover, cap, etc.) that is cooperatively received by the receiving structure.

The receiving structure of the closure can typically be either (1) a separate structure that can be attached at the container opening, and that defines a passage through the structure for communicating with the container opening and the container interior, or (2) an integral structure that is a unitary portion of the container, and which defines a passage through the structure such that the passage functions as the opening, per se, to the container.

The closing element typically is movable relative to the receiving structure passage between (1) a fully closed position occluding the passage, and (2) an open position at least partially exposing the passage. Some closures may include additional elements (e.g., tamper-evident features, locking elements, etc.).

A closure specifically designed for dispensing a fluent substance may be described as a dispensing closure. Various fluent materials or substances (including oils, lotions, creams, gels, liquids, food items, granules, powders, etc.) may be packaged in a rigid, flexible, or collapsible container having a dispensing closure that can be opened and closed. A flexible container may be pressurized by a user to force the fluent substance from the container and through the closure body to dispense the fluent substance at a target region or onto a target surface area. The container with the closure mounted thereon, and the contents stored therein, may be characterized as a "package."

One type of closure is typically provided with a closing element in the form of a lid that is hingedly attached, or otherwise connected, to a closure body. A user of such a closure would typically encounter the lid in a closed position. The lid may be provided with a region for being lifted by a user of the closure to rotate the lid with respect to a stationary portion of the closure (e.g., closure body), thus moving the lid from the closed position into an open position such that a fluent substance may be dispensed through the closure.

The inventor of the present invention has noted that such closures, when installed on a container of a fluent substance, may be susceptible to inadvertent opening during shipping or handling, which can result in premature or messy leaking of the fluent substance stored within the container. For example, the closed lid may be accidentally bumped open, or the lid may accidentally open if the inside of the lid is subjected to a sudden impact from the fluent substance or if the internal pressure of the container increases significantly during shipping or storage in high temperature environments. The inventor has found that such premature leakage through a conventional closure may be especially pronounced in an e-commerce scenario, whereby an individual package is shipped and handled in an unconstrained manner and may be subjected to a variety of forces, orientations, and temperatures.

The inadvertent opening of such a closure may be prevented, or at least minimized, by applying an adhesive seal or a film wrap around at least a portion of the closure to mechanically prevent movement of the lid until the seal or wrap has been removed by a user of the closure. However, such additional adhesive seals and film wraps are typically designed and provided for only a "one-time" use (non-reusable) application to withstand lid opening forces during shipping. Moreover, such additional seals or wraps may increase the cost of the closure, require additional manufacturing steps, or present a nuisance to the user who must remove and discard such a seal.

Furthermore, the inventor has found that the inadvertent opening of such a closure may be prevented, or at least minimized, by molding or otherwise forming the closure with a removable plastic tear band or tamper band to mechanically prevent movement of the lid until the tear band or tamper band has been removed by a user of the closure. However, such additional features may increase the cost and complexity of the closure and are typically designed and provided for only a "one-time" use (non-reusable) application to withstand lid opening forces during shipping.

The inventor of the present invention has determined that it would be desirable to provide a robust closure that may prevent or minimize the likelihood of the inadvertent opening of the closure during shipping or handling. The inventor of the present invention has further found that it would be beneficial to provide a closure that includes a unitarily formed lid and body, which would not require separate assembly and would be amenable to mass production.

The inventor of the present invention has also determined that, in many applications, it may be desirable to provide an improved closure that minimizes the likelihood of inadvertent opening of the closure during shipping or handling as part of a package wherein the improved closure eliminates the need for any additional protective packaging, such as a larger box or carton, or the inclusion of dampening structures or inserts that would otherwise be included to minimize the likelihood of the inadvertent opening of the closure.

The inventor of the present invention has also determined that it would be desirable to provide an improved closure that minimizes the likelihood of inadvertent opening of the closure during shipping or handling and that such an improved closure would open only when engaged by a user applying a specific, yet simple, action to disengage the lid from the body of the closure.

The inventor of the present invention has also determined that, in many applications, it may be desirable to provide an improved closure as part of a package wherein the closure structure facilitates or accommodates the cleaning of the closure and/or minimizes the potential for accumulation of residue, dirt, grime, etc. during the useful life of the package.

The inventor of the present invention has also determined that it would be desirable to provide an improved closure that can be configured for use with a container of a fluent substance so as to have one or more of the following advantages: (1) an improved ease of manufacture and/or assembly, and (ii) a reduced cost of manufacture and/or assembly.

The inventor of the present invention has invented a novel structure for a closure for use with a container wherein the closure includes various advantageous features not heretofore taught or contemplated by the prior art.

BRIEF SUMMARY OF THE INVENTION

According to broad aspects of one form of the present invention, a closure is provided for use with a container having an opening between an exterior of the container and an interior of the container where a substance may be stored. The closure has a closure body that can be located at the container opening and that defines an inlet portion for communicating with the container. The closure body further defines a through passage terminating in an orifice to accommodate the movement of a substance through the closure body. The closure body further defines a first latch portion.

The closure has a lid that is connected to the closure body and that is movable between (i) a closed position occluding the orifice, and (ii) an open position spaced from the orifice. The lid includes a flexible, recessed press portion defining a second latch portion.

The closure body and the lid have a latched configuration with the lid in the closed position, wherein the first latch portion and the second latch portion are oriented in a confronting relationship to prevent the lid from moving into its open position.

The closure body and the lid further have an unlatched configuration with the lid in the closed position wherein the recessed press portion is deflected inwardly to move the second latch portion out of the confronting relationship with the first latch portion to permit the lid to move from its closed position into its open position.

In one aspect of the present invention, the closure body is one of the following: a separate structure for being attached to the container at the container opening; and an integral structure that is a unitary part of a container formed at the container opening.

In another aspect of the present invention, the body and the lid are connected by a hinge and are formed together as a unitary structure.

In yet another aspect of the present invention, the lid further includes a lift projection that extends laterally outwardly beyond the recessed press portion, and which is also located above the recessed press portion, when the lid is located in its closed position.

In another aspect of the present invention, the body further includes an aperture which is located laterally inwardly, toward the interior of the body, of the first latch portion. The aperture accommodates the second latch portion of the lid when the lid is located in its closed position.

In still another aspect of the present invention, the body further includes a resilient spring member which is located laterally inwardly of the first latch portion. The resilient spring member is configured to bias the recessed press portion laterally outwardly with the closure body and the lid in their latched configuration.

In still another aspect of the present invention, the body includes a top deck from which the resilient spring member projects downwardly and laterally outwardly.

In one aspect, the resilient spring member is a generally rectangular tab having a proximal end extending from the top deck and a distal end configured to engage the recessed press portion when the closure body and the lid are in their latched configuration.

In yet another aspect of the invention, the resilient spring member includes a central rib extending from the top deck along an inner side of the resilient spring member.

In another form of the present invention, the resilient spring member is a partial dome having a laterally outward, convex side and a laterally inward, concave side. The convex side of the dome is configured to engage the recessed press portion with the closure body and the lid located in their latched configuration.

According to another form of the present invention, the body further includes a top deck and a spout extending from and above the top deck. The orifice is located in the spout. The lid includes a top end and a cylindrical wall extending downwardly from the top end for sealing around the spout with the lid located in its closed position.

In another form of the present invention, the closure body includes a peripheral skirt and the first latch portion extends radially inwardly from the peripheral skirt. The first latch portion has a sloping top surface and a substantially flat bottom surface. The lid's second latch portion extends radially outwardly and has a sloping bottom surface and a substantially flat top surface with the lid located in its closed position.

In yet another form of the invention, the first and second latch portions are located below the connection between the lid and the closure body with the lid located in its closed position. The lift projection is located above the connection between the lid and the closure body with the lid located in its closed position In yet another form of the invention, the recessed press portion is configured to deflect elastically inwardly in response to a force applied by a user to move the second latch portion out of the confronting relationship with the first latch portion, which permits the lid to be moved by a user from its closed position into its open position.

In one form of the invention, the lid and the closure body are generally cylindrical. Furthermore, each of the first latch portion and the second latch portion are arcuate in shape, and have a length that extends generally around a portion of the respective periphery of the lid and the closure body. Preferably, the first latch portion and the second latch portion each have an arcuate shape that defines a central angle of between about twenty-five degrees and about thirty-five degrees relative to a central axis of the closure.

In one form of the invention, the closure is provided in combination with a container of a fluent substance in the form of a package.

According to another aspect of the present invention, a closure is provided for use with a container having an opening between an exterior of the container and an interior of the container where a substance may be stored. The closure has a closure body that can be located at the container opening and that defines an inlet portion for communicating with the container. The closure body further defines a through passage terminating in an orifice to accommodate the movement of a substance through the closure body. The closure body further defines a first latch portion.

The closure has a lid that is hingedly connected to the closure body, and unitarily molded with the closure body. The lid is movable between (i) a closed position occluding the orifice, and (ii) an open position spaced from the orifice. The lid includes a flexible, recessed press portion defining a second latch portion. The lid further includes a lift projection extending laterally outwardly beyond, and located above, the recessed press portion with the lid in its closed position.

The closure body and the lid have a latched configuration with the lid in the closed position, wherein the first latch portion and the second latch portion are oriented in a confronting relationship to prevent the lid from moving into its open position.

The closure body and the lid further have an unlatched configuration with the lid in the closed position wherein the recessed press portion is elastically deflected inwardly to move the second latch portion out of the confronting relationship with the first latch portion to permit the lid to move from its closed position into its open position.

It should be appreciated that the invention may include any or all of the above-described features, include only one of the above features, more than one of the above features, and any combination of the above features. Furthermore, other objects, features and advantages of the invention will become apparent from a review of the entire specification including the appended claims and drawings.

BRIEF DESCRIPTION OF THE DRAWINGS

In the accompanying drawings forming part of the specification, in which like numerals are employed to designate like parts throughout the same.

FIG. 6 shows the latching feature of the lid moved away from and out of a confronting relationship with the latching feature of the closure body;

FIG. 7 shows the lid rotated away from the closed position into an open position;

FIG. 8 shows the closure with the lid oriented in an as-molded, open position;

FIG. 9 shows the closure with the lid oriented in an as-molded, open position;

FIG. 12 shows the lid of the closure in the closed position and the closure in a latched configuration;

FIG. 14 shows the latching feature of the lid moved away from the latching feature of the closure body;

FIG. 17 shows the lid of the closure in the closed position and the closure in a latched configuration;

FIG. 19 shows the latching feature of the lid moved away from the latching feature of the closure body;

DESCRIPTION OF THE PREFERRED EMBODIMENT

Figure 1:
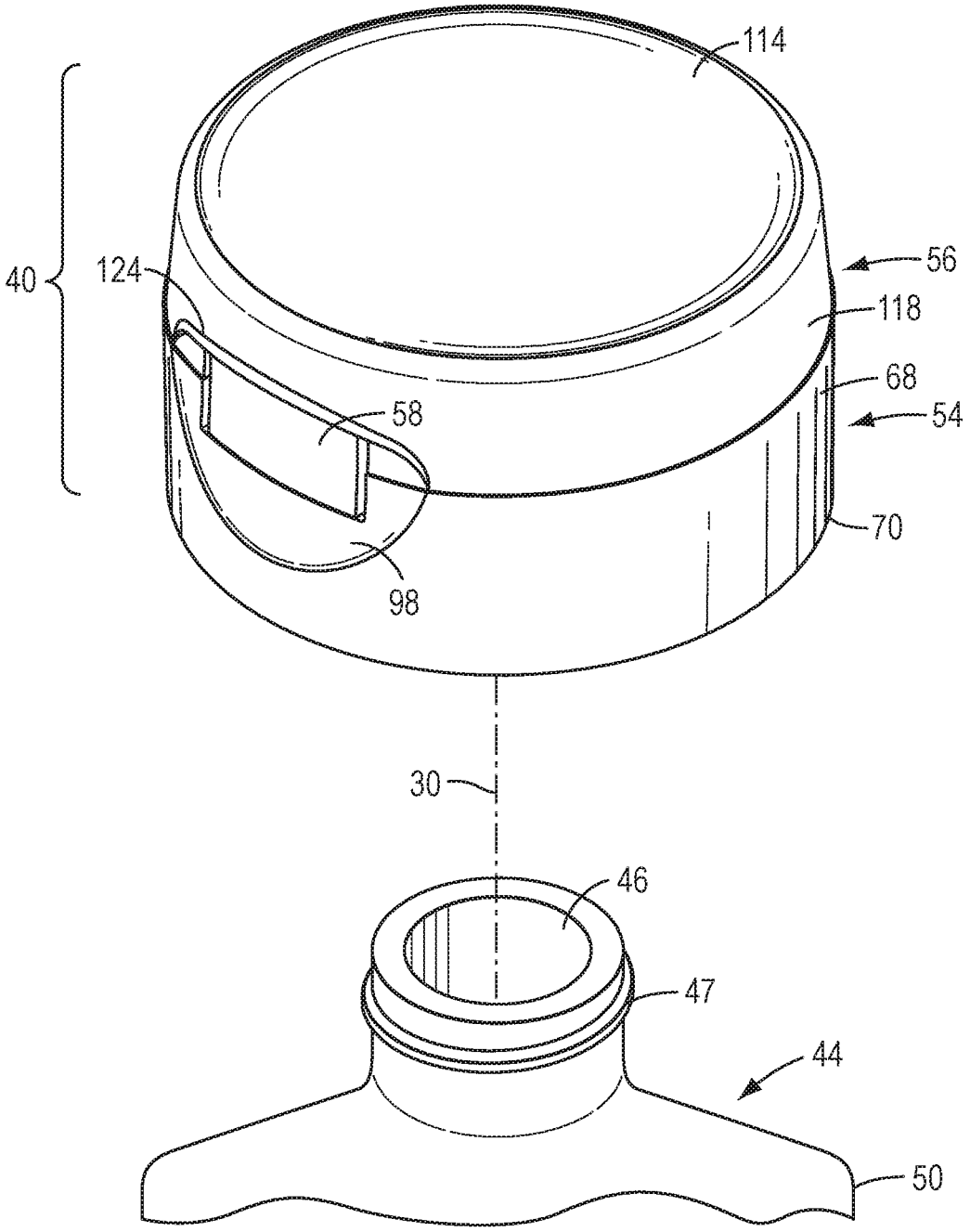
FIG. 1 is an exploded perspective view, taken from above, of a first embodiment of a closure of the present invention shown with the lid in the closed position and the closure in a latched configuration, the closure prior to being installed at the opening of a container wherein only a fragmentary, upper portion of the container is illustrated in FIG. 1.

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

For ease of description, many figures illustrating the invention show embodiments of a closure in the typical orientation that the closure would have when located at the opening of a container, the container in the form of an upright bottle, and terms such as "inward", "outward", "upper", "lower", "axial", "radial", "lateral", etc., are used with reference to this orientation. The term "axially inward" is to be understood as in the direction along a central axis 30 (visible in FIGS. 3-5) of the closure, toward the interior of the container. The term "axially outward" is to be understood as in the direction along a central axis 30 of the closure, away from the interior of the container. The term "radially inward" is to be understood as in the radial direction toward the central axis 30 of the closure. The term "radially outward" is to be understood as in the radial direction away from the central axis 30 of the closure. The term "laterally inward" is to be understood as in a direction toward the central axis 30 of the closure, in a plane normal to the central axis 30. The term "laterally outward" is to be understood as in a direction away from the central axis 30 of the closure, in a plane normal to the central axis 30. It will be understood, however, that the closures of this invention may be manufactured, stored, transported, used, and sold in an orientation other than the orientation described and illustrated.

The closures of this invention are especially suitable for use with a variety of conventional or special containers, the details of which, although not fully illustrated or described, would be apparent to those having skill in the art and an understanding of such containers. The particular container illustrated is not intended to limit the present invention. It will also be understood by those of ordinary skill that novel and non-obvious inventive aspects are embodied in the described closures alone.

The closures described herein are especially suitable for use on a container that contains a fluent material or substance in the form of a lotion or cream that can be dispensed, or otherwise discharged, from the container through the opened closure. Such fluent substances may be, for example, a personal care product, a food product, an industrial product, a household product, or other types of products. Such substances may be for internal or external use by humans or animals, or for other uses (e.g., activities involving medicine, commercial or household maintenance, agriculture, manufacturing, etc.).

A first embodiment of a closure of the present invention is illustrated in FIGS. 1-9, wherein the closure is designated generally by the reference number 40. The first illustrated embodiment of the closure 40 has the form of a separate article that is configured to be attached or assembled to a container 44 (a portion of which is visible in FIG. 1 only) at the container opening 46 (FIG. 1 only), the container 44 having the form of a bottle that would typically contain a fluent substance.

It will be understood that the container may be any conventional type, such as a collapsible, flexible pouch, or may be a generally rigid bottle that has somewhat flexible, resilient walls. FIG. 1 shows the first embodiment of the closure 40 for being attached to a container 44 which is a generally rigid bottle having a wall that is somewhat flexible and that can be squeezed by the user to dispense a product when the closure 40 is opened and the container 44 is inverted by the user. In other applications, the closure 40 may instead be used on a larger dispensing system (not illustrated) which may include, or be part of, for example, a medical device, processing machine, dispenser, reservoir on a machine, etc., wherein the system has an opening to the system interior.

The container, or a portion thereof, may be made from a material suitable for the intended application. For example, the container may be a pouch made from a thin, flexible material (wherein such a material could be a polyethylene terephthalate (PET) film or a polyethylene film and/or an aluminum foil). Alternatively, a more rigid container (e.g., a bottle) could be made from a thicker, less flexible material such as molded polyethylene, polypropylene, polyethylene terephthalate, polyvinylchloride, glass, or other materials.

In applications wherein the closure is mounted to a container such as a bottle, it is contemplated that typically, after the closure manufacturer would make the closure (e.g., by molding the closure from a thermoplastic polymer), the closure manufacturer will then ship the closure to a container filler facility at another location where the container is either manufactured or otherwise provided, and where the container is filled with a product prior to installation of the closure. If the container is a collapsible pouch, then the closure may include a suitable fitment portion that can be sealed or otherwise attached to the pouch as the pouch is being made and filled, or as the pouch is being made but before the pouch is subsequently filled through the open closure or through open regions of the pouch walls that are later sealed closed.

In the first illustrated embodiment of the closure 40 in FIGS. 1-9, the closure 40 is provided as a separately manufactured article, component, or unit for being snap fit onto the upper, open end of the container 44. It will be appreciated, however, that in some applications, it may be desirable for the closure 40 to be screw threaded onto a container or attached to a container in a tamper-resistant manner that would not allow a user to easily remove the closure 40. Further, it may be desirable for the closure (or at least the body of the closure) to be formed as a unitary part, or extension, of the container (e.g., a bottle) wherein such a unitary part or extension also (i.e., simultaneously) defines an end structure of the container, per se.

The container 44, per se, does not form a part of the broadest aspects of the present invention. The container may have any suitable configuration.

With reference to FIG. 1, the container 44 is a bottle, which includes an upper end portion that defines the container mouth or opening 46 and a snap-fit bead 47 or threaded portion (not illustrated) for mating with a cooperating snap-fit bead 48 (or threaded portion, not illustrated) of the closure 40, which is discussed in detail hereinafter. The container upper end portion has a cross-sectional configuration with which the closure 40 is adapted to engage. Extending downwardly from the container upper end portion is a depending main body portion 50 of the container. The main body portion 50 of the container 44 has a cross-sectional configuration which is larger than the cross-sectional configuration of the container upper end portion at the container opening 46. In other types of containers, the container may instead have the same shape along its length or height.

The first embodiment of the closure 40 illustrated in the FIGS. 1-9 is especially suitable for use with a container 44 that is a bottle having a substantially flexible wall or walls that can be squeezed or deflected laterally inwardly by the user to increase the internal pressure within the container 44 so as to force the fluent substance out of the container 44 and through the opened closure 40—especially when the user inverts the container 44 while squeezing. The walls have sufficient, inherent resiliency so that when the squeezing forces are removed, the container walls return to the normal, unstressed shape.

In other applications, it may be desirable to employ a generally rigid container, and to pressurize the container interior at selected times with a piston or other pressurizing system (not illustrated), or to reduce the exterior ambient pressure so as to suck the material out through the open closure.

In some other applications, the closure 40 may be used with a product containment system or other type of system (not illustrated), where the closure 40 can function to permit or prevent the egress or ingress of substances relative to the system in which the closure 40 is installed. For example, in some applications it may be desirable to also accommodate filling or refilling of the container 44 with the fluent contents through the opened closure 40 into the container 44.

Figure 6:
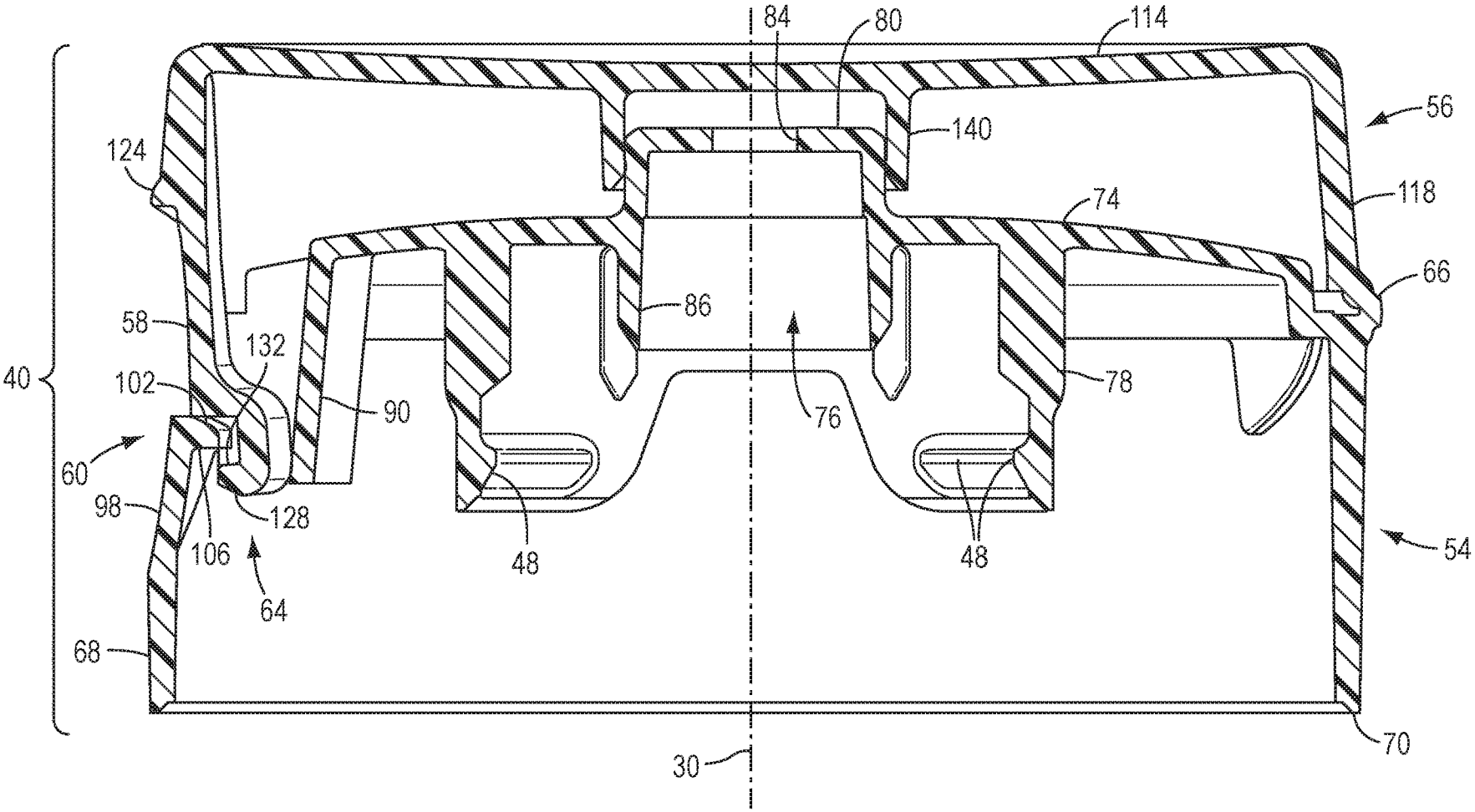
FIG. 6 is a cross-sectional view of the closure that is similar to FIG. 5, except
Figure 8:
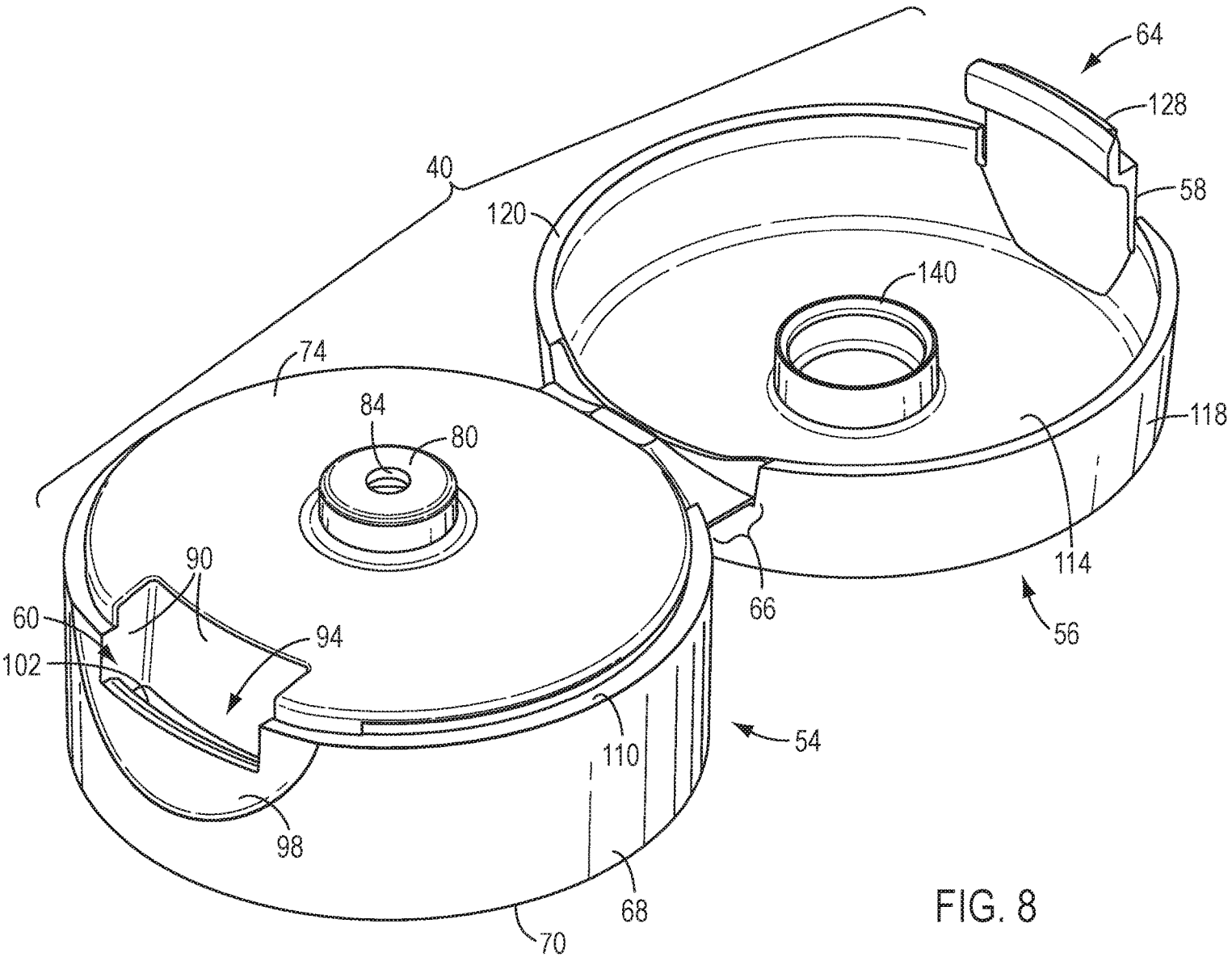
FIG. 8 is a perspective view, taken from above and in front, of only the closure illustrated in FIG. 1.
Figure 9:
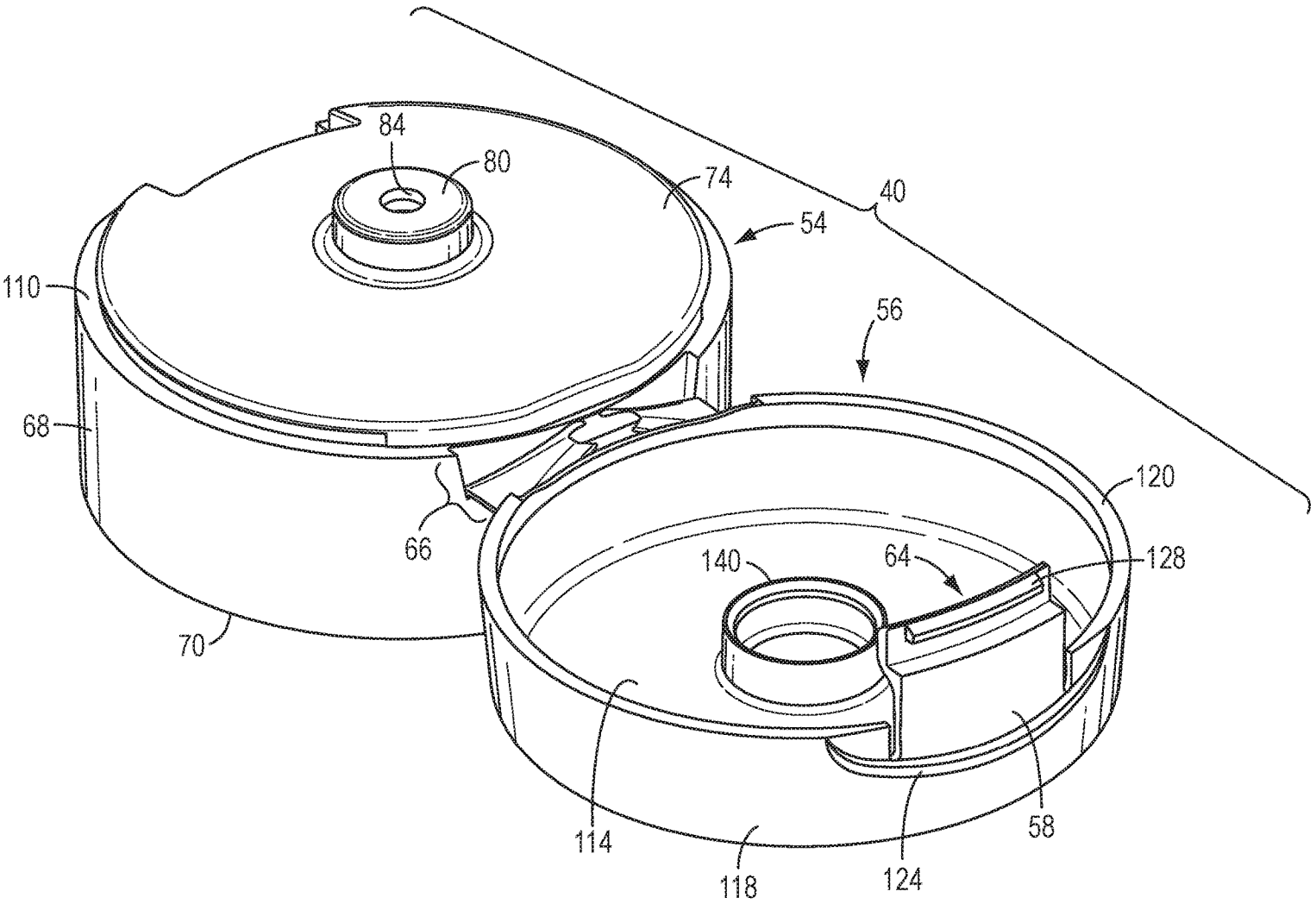
FIG. 9 is a perspective view, taken from above and behind, of only the closure illustrated in FIG. 1.

With reference now to FIGS. 8 and 9, the closure 40 includes the following basic components of a closure body 54 and a lid 56 that is movably mounted atop the closure body 54. The lid 56 is provided with a flexible, recessed press portion 58 for being pressed by a finger or thumb of a user of the closure 40, and the recessed press portion 58 is laterally inwardly movable or deflectable in response to the force applied by the user (as shown in FIG. 6). The closure body 54 defines a first latch portion 60 and the recessed press portion 58 of the lid 56 defines a second latch portion 64, the detailed structure of which will be discussed in herein. The lid 56 and the closure body 54 have a latched configuration that exists when the first latch portion 60 of the closure body 54 and the second latch portion 64 of the lid 56 are oriented in a confronting (interfering but spaced) relationship, securing the lid 56 atop the closure body 54. In other embodiments (not illustrated), the first and second latch portions may be in contact and abutting in the confronting relationship. The lid 56 and the closure body 54 also have an unlatched configuration that exists when the first latch portion 60 of the closure body 54 and the second latch portion 64 of the lid 56 are moved out of the confronting relationship, permitting the user to lift the lid 56 to move it relative to the closure body 54.

The closure body 54 and the lid 56 are preferably formed or molded as a unitary structure from a suitable thermoplastic material such as polypropylene or polyethylene. Other materials may be employed instead. It will be understood that in alternative designs (not illustrated), one or more of the basic components or sub-components may be separately or sequentially formed or molded (such as through bi-injection molding). Alternatively, the basic components may be molded initially as one connected structure, and then broken apart, and then re-assembled into an operative combination. Further, it will be understood that in an alternate embodiment (not illustrated), the closure body 54 may be unitarily formed or molded as an extension of the upper end of the container 44 and need not be a separately formed article of manufacture.

With reference to FIGS. 8 and 9, the lid 56 is connected to the closure body 54 by a hinge 66 and is movable between an open position (FIGS. 8 and 9) and a closed position (FIGS. 1-5). One form of a hinge that may be used is an over-center, butterfly, snap-action type hinge. Other types of hinges could be used depending on the specific application. In some applications, the hinge between the lid and the closure body could be omitted altogether, such that the lid is not connected as a unitary part of the closure body (e.g., the lid is connected to the closure body by a screw thread, tether, or snap fit connection). In alternative embodiments (not illustrated), the lid may be a separate component adapted to be mounted to, and completely removed from, the closure body.

Figure 7:
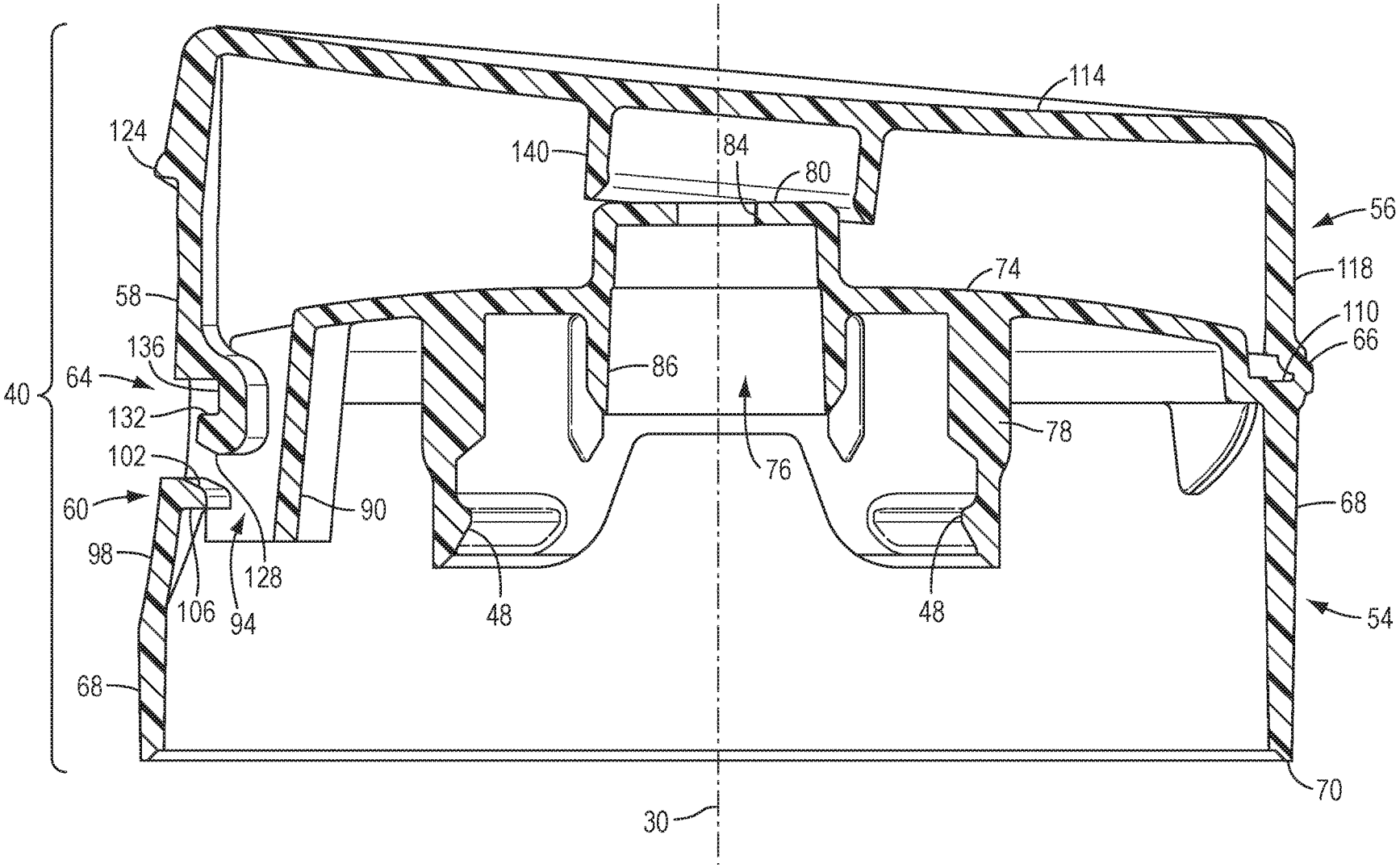
FIG. 7 is a cross-sectional view of the closure that is similar to FIG. 6, except

As will be discussed in greater detail below, the second latch portion 64 of the lid 56 is movable relative to the first latch portion 60 of the closure body 54, between (i) a latched configuration (FIGS. 4 and 5) with the lid 56 in its closed position, and (ii) an unlatched configuration (FIG. 6) with the lid 56 in its closed position. In the latched configuration, the first and second latch portions 60 and 64 are sufficiently confronting (e.g., either in a non-touching confronting relationship (as seen in FIG. 5), or in an alternate embodiment (not illustrated) in a contacting, abutting confronting relationship) to prevent the lid 56 from moving out of its closed position (FIGS. 1-5) toward an open position (FIGS. 7 and 8). In the unlatched configuration the first and second latch portions 60 and 64 are separated or spaced sufficiently to permit the lid 56 to be rotated about the hinge 66 away from the closed position (FIGS. 1-5) toward an open position (FIG. 7 showing the lid 56 slightly open and FIG. 8 showing the lid 56 open to a greater extent).

As used in this specification and claims with respect to the first embodiment of the closure 40, and the other embodiments, the term "unlatched configuration" means a relative orientation of the first and second latch portions 60 and 64 in which the second latch portion 64 of the lid 56 is moved sufficiently inwardly and away from the first latch portion 60 of the closure body 54 such that the two structures are sufficiently moved apart from one another to permit the lid 56 to be moved from its closed position to an open position as will be explained in detail hereinafter. The recessed press portion 58 of the lid 56, which defines the second latch portion 64, is preferably sufficiently resilient or elastic to return to its as-molded configuration after being pressed laterally inwardly by a user of the closure 40 to move the first and second latch portions 60 and 64 apart. An upwardly directed secondary force is required by the user to lift the lid 56 away from the closed position over the closure body 54 while the user is simultaneously depressing the recessed press portion 58 of the lid 56.

The inventor has found that closure 40 is especially suited for preventing inadvertent opening of the lid 56 during the shipping and handling of the closure 40 attached to a container 44 of a substance in the form of a package, such as in e-commerce, whereby the package may be packed in one of a number of possible orientations and may be shipped in a wide variety of parcels that may be subjected to a wide range of impulse forces, vibrations, pressures, temperatures, and changes in orientation. Inadvertent opening of the lid 56 may result in undesirable leaks of the substance during transit and/or damage to the lid 56 or hinge 66 during transit. The inventor has further found that the closure 40 may be especially robust in the above-mentioned scenarios because the closure 40 requires specific, yet simple actions from the user upon the recessed press portion 58 in order to move the latch portions 60 and 64 apart and open the lid 56, and such actions are not readily replicated by random forces to which the package is subjected during transit of the package from the manufacturer to the ultimate end user.

Referring now to FIGS. 5 and 6, the closure body 54 includes a generally cylindrical skirt or outer wall 68 having an inlet portion or lower end 70 and a transverse wall or top deck 74. The closure body 54 is hollow and defines a through passage 76 for being located at the opening 46 of the container 44 (FIG. 1) to communicate with an interior of the container 44 which contains a substance to be dispensed. While the closure body 54 is illustrated as having a generally cylindrical shape, it will be appreciated, however, that the closure body 54 may take a variety of forms and need not be limited to a cylindrical shape. For example, the outer wall 68 may be elliptical, polygonal, or some other, irregular cross-sectional shape, when viewed in a plane that is normal to the central axis 30.

Still referring to FIGS. 5 and 6, the interior of the closure body 54 is provided with an internal wall 78 that extends below the deck 74 and which is provided with a plurality of the aforementioned snap-fit beads 48. The snap-fit beads 48 extend radially inwardly from the internal wall 78 and cooperate with one or more external beads 47 on the container 44 (FIG. 1) to securely attach the closure body 54 to the container 44 at the opening of the container 44. It will be appreciated that other conventional or special means of connecting the closure body 54 to the container 44 could be employed, such as mating screw threads, bi-injection molding, adhesives, mechanical locks, spin welding of the closure to the container, etc.

If the closure body is to be used on a flexible pouch (not illustrated), then it is presently contemplated that the closure body lower end would have a suitable boat-shaped fitment configuration (e.g., such as that shown and described in PCT/US2013/043065, which is incorporated by reference herein in its entirety) for being sealed with the pouch, and most pouch manufacturers will prefer to install the closure body lower end at an opening formed in the pouch with heat sealing techniques or ultrasonic sealing techniques.

Referring now to FIGS. 5 and 8, the closure body deck 74 has a raised, cylindrical spout 80 extending upwardly therefrom and has a circular, central hole or orifice 84 therein in communication with the through passage 76 for permitting communication of a substance through the closure 40 (e.g., dispensing or filling) when the lid 56 is sufficiently opened (e.g., FIG. 8) relative to the closure body 54. With reference to FIG. 5, the closure body 54 is further provided with a second cylindrical wall 86 that extends downwardly from the deck 74, into the hollow body 54, and which mates within the inside surface of the opening 46 at the upper end of the container 44 (FIG. 1).

Referring to FIGS. 5 and 8, a front portion of the top deck 74 of the closure body 54 is provided with a plurality of downwardly-extending walls 90, the internal surfaces of which define a channel, recess or aperture 94 in the top deck 74. The aperture 94 is located on an opposite side of the closure body 54 with respect to the hinge 66 that connects the closure body 54 with the lid 56. The aperture 94 accommodates movement of the second latch portion 64 of the lid 56 into a confronting relationship with the first latch portion 60 of the closure body 54, when the lid 56 is placed in its closed position relative to the closure body 54.

Referring now to FIGS. 5-7, the outer wall 68 of the closure body 54 defines a recessed, semi-circular, sloping surface 98 at the front thereof, which leads inwardly to the first latch portion 60. The first latch portion 60 extends radially inwardly from the wall 68 into the aperture 94 (as shown in FIG. 7). The first latch portion 60 has an inwardly and downwardly sloping top surface 102 and a substantially flat bottom surface 106. The sloping top surface 102 functions to guide the second latch portion 64 of the lid 56 laterally and axially inward past first latch portion 60. The bottom surface 106 functions to confront a mating flat surface of the second latch portion 64 of the lid 56, as discussed in greater detail hereinafter. When the closure 40 is in its as-molded, open position (as illustrated in FIGS. 8 and 9), and each of the first and second latch portions 60 and 64 is viewed in a plane normal to the central axis 30, each of the first and second latch portions 60 and 64 has an arcuate length that extends generally around a small portion of the perimeter of the closure 40. The arcuate first and second latch portions 60 and 64 preferably each define an internal angle of between about twenty-five to about thirty-five degrees, relative to the central axis 30.

Figure 2:
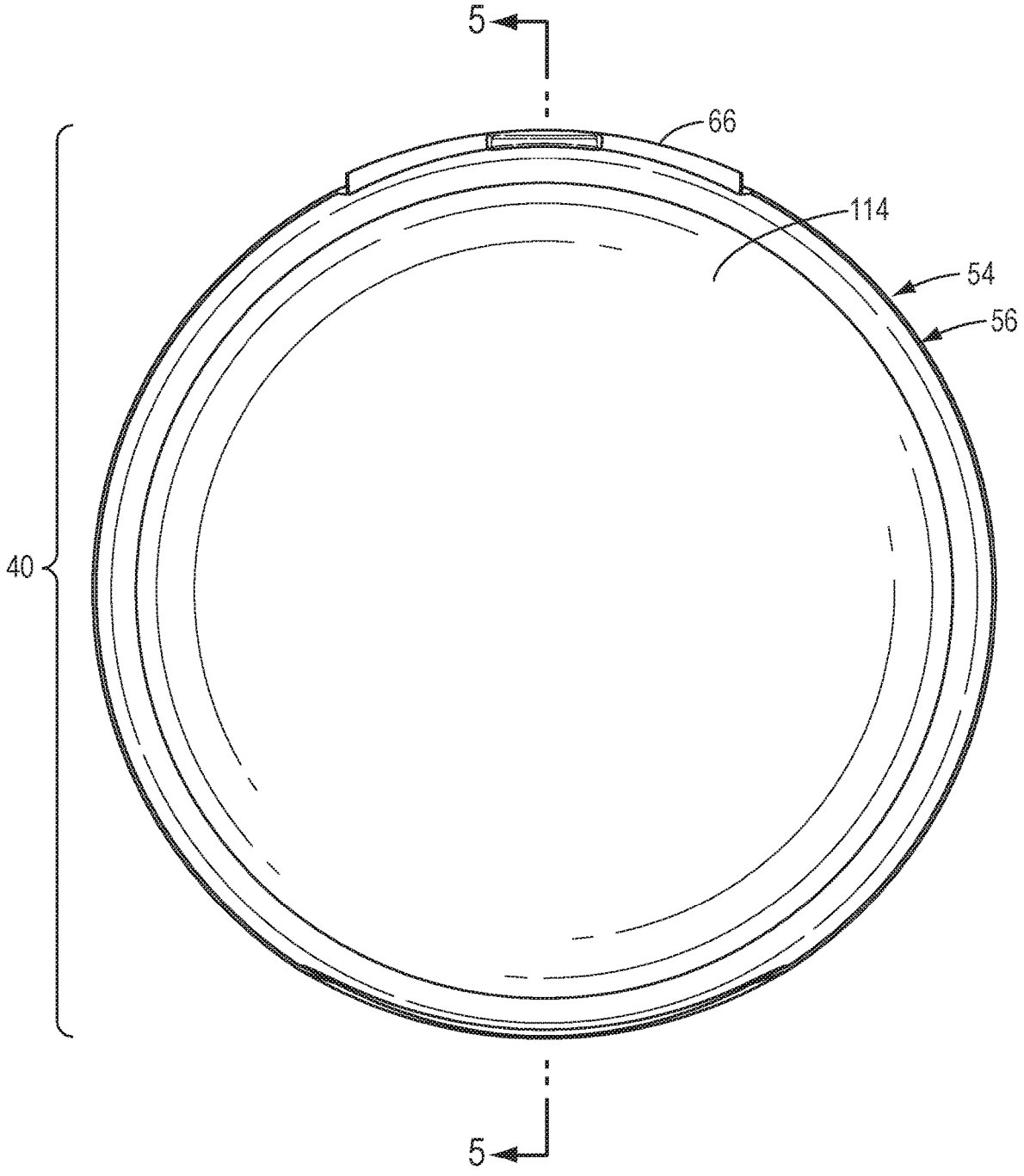
FIG. 2 is a top plan view of only the closure illustrated in FIG. 1.

As shown in FIGS. 8 and 9, the outer wall 68 of the closure body 54 defines a substantially flat circumferential shoulder 110 for confronting and accommodating a bottom surface of the lid 56 when the lid 56 is in the closed position atop of the closure body 54 (as is illustrated in FIGS. 1 and 2).

Figure 3:
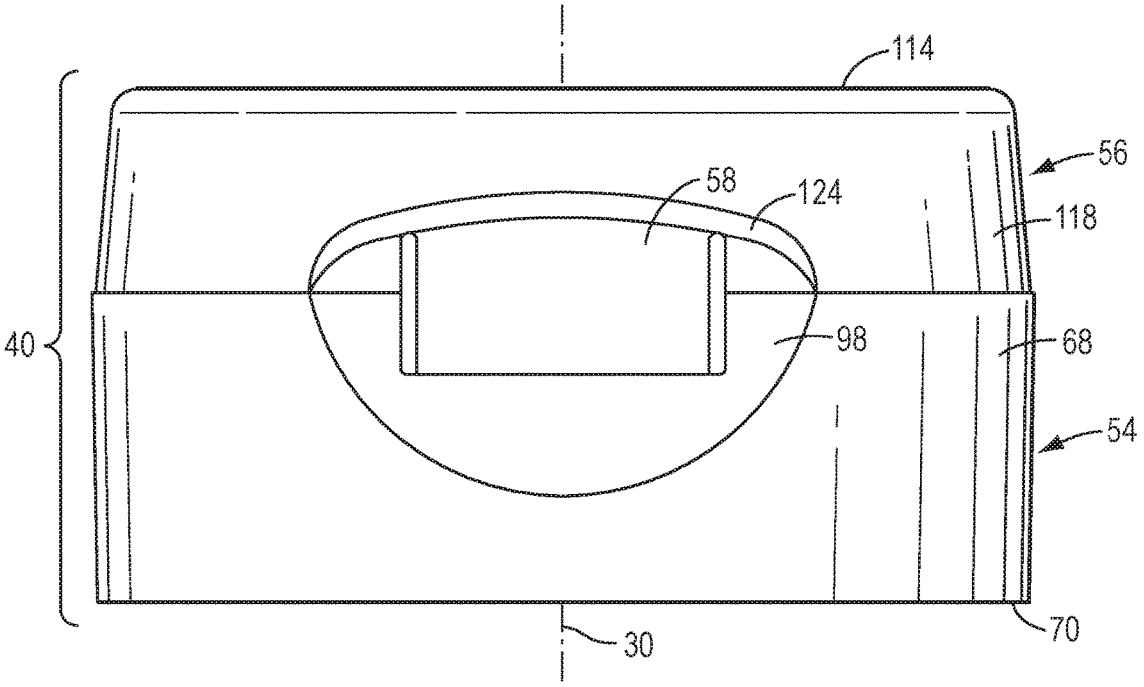
FIG. 3 is a front elevation view of only the closure shown in FIG. 1.
Figure 4:
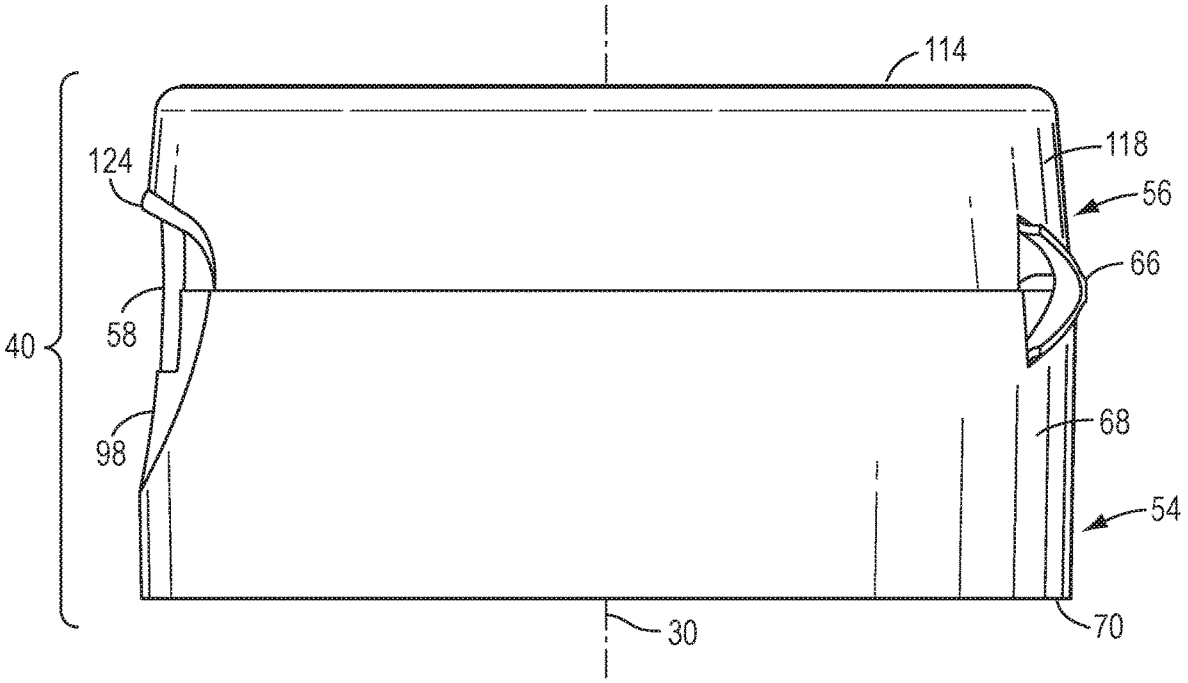
FIG. 4 is a is a right side elevation view of only the closure shown in FIG. 1.
Figure 5:
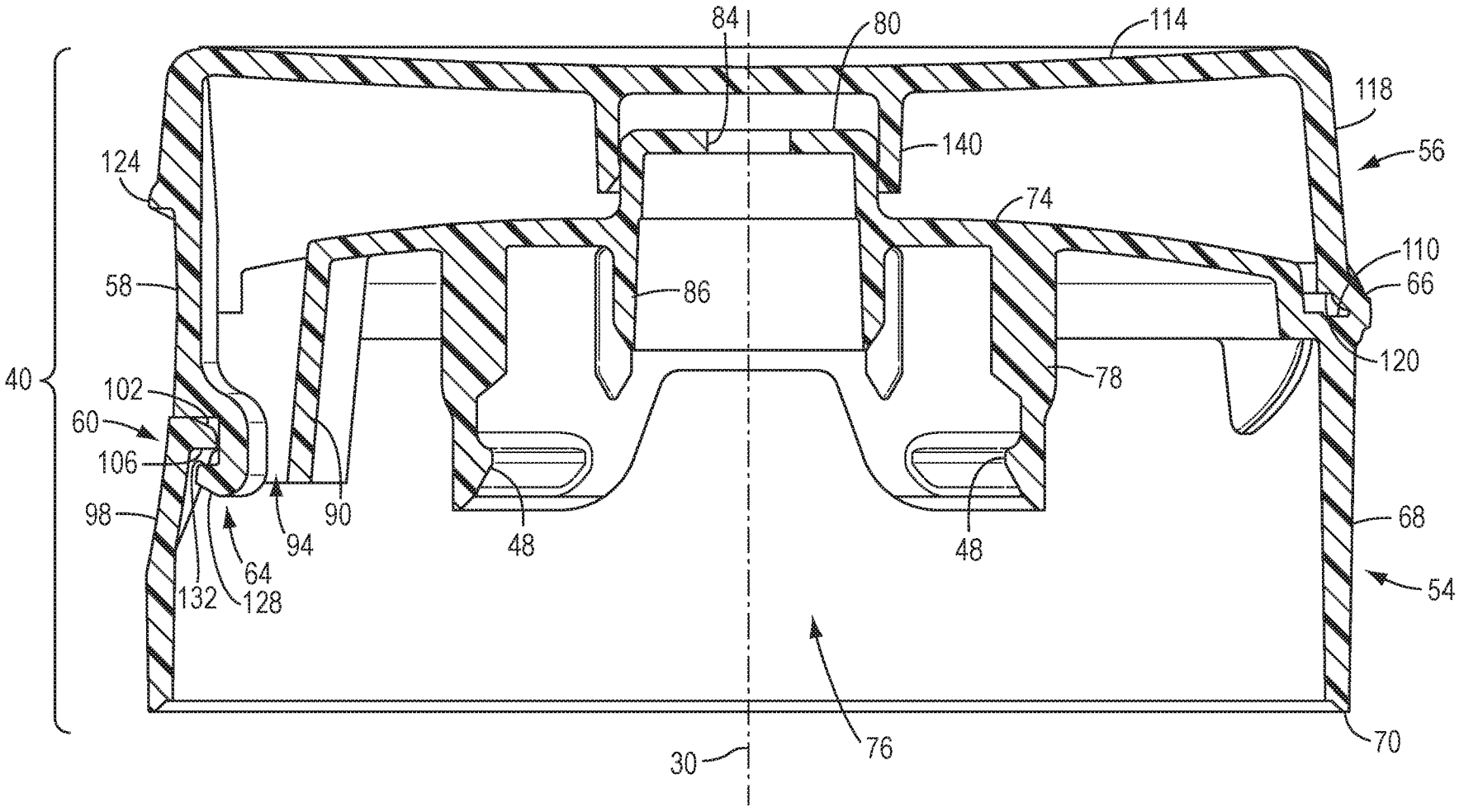
FIG. 5 is a cross-sectional view of only the closure illustrated in FIG. 1, taken generally along the plane 5-5 in FIG. 2.

Referring now to FIGS. 3, 4, and 9, the lid 56 has a somewhat planar transverse cover or top end 114 with a substantially cylindrical, circumferential peripheral wall 118 extending therefrom. The wall 118 has a bottom, annular surface 120 (FIGS. 8 and 9) that confronts or abuts the shoulder 110 of the closure body 54 with the lid 56 in the closed position. The front region of lid wall 118 defines a finger lift or projection 124, extending above and around the recessed press portion 58, for accommodating a finger or thumb of a user to lift the lid 56 away from the closure body 54 after the user has disengaged or moved the first and second latch portions 60 and 64 out of their confronting relationship. The projection 124 is somewhat arcuate in shape, and overhangs the recessed press portion 58 when the lid 56 is closed.

In FIGS. 4 and 5, it can be seen that the recessed press portion 58 is located substantially laterally inwardly of each of the projection 124 of the lid 56 and the upper end of the sloping surface 98 of the closure body 54. This configuration provides the closure 40 with a robust latching mechanism that minimizes the likelihood of inadvertent opening of the lid 56 during transit, while presenting a user with a conveniently located area of contact for actuating the latching mechanism of the closure 40.

As best seen in FIG. 7, the detailed structures of the second latch portion 64, which extends from the distal end of the recessed press portion 58, will next be discussed. The second latch portion 64 is generally hook-shaped, when viewed in a vertical cross-sectional plane that contains the central axis 30 and that extends through the center of the second latch portion 64. As previously discussed above, the second latch portion 64 is arcuate when viewed from above (e.g., FIGS. 8 and 9) to conform to the curvature of the generally cylindrical wall 118 of the lid 56. As seen in FIGS. 8 and 9, the second latch portion 64 includes a chamfered or sloping bottom surface 128 and a substantially flat top surface 132. The second latch portion 64 is spaced from the remainder of the recessed press portion 58 by a recess 136 located axially outwardly from, or above, the top surface 132, with the lid 56 in the closed position (e.g., FIG. 5).

With reference to FIG. 5, when the lid 56 is rotated from an open position toward the closed position atop the closure body 54, the sloping bottom surface 128 of the second latch portion 64 of the lid 56 cooperates with the sloping top surface 102 of the first latch portion 60 to guide the second latch portion 64 axially and laterally inward past first latch portion 60. Movement of the second latch portion 64 axially inward of the first latch portion 60 into the latched configuration causes the recessed press portion 58 to deflect temporarily laterally inward. The flat top surface 132 of the second latch portion 64 is slightly spaced from, yet confronts, the bottom surface 106 of the first latch portion 60 to prevent any substantial movement of the lid 56 away from its closed position when the lid 56 and closure body 54 reach their latched configuration in FIG. 5. Furthermore, in the latched configuration, the first latch portion 60 is laterally constrained within the recess 136 of the second latch portion 64.

With reference to FIGS. 5 and 8, the top end 100 of the lid 56 is provided with a plug seal or internal cylindrical wall 140 extending downwardly therefrom, which serves to seal against the periphery of the spout 80 of the closure body 54 when the lid 56 is located in the closed position (FIG. 5), so as to occlude the orifice 84 of the closure body 54 and prevent ingress or egress of a substance through the closure 40.

One method of assembling the closure 40 is next discussed. It will be understood that the method of assembly described herein is illustrative only, and there may be other methods of assembling the components of the closure 40. The closure body 54 and the lid 56 are preferably integrally molded in the configuration shown in FIGS. 8 and 9, whereby the lid 56 is oriented in an open position. The lid 56 is subsequently rotated about the hinge 66 with respect to the closure body 54 into the orientation shown in FIG. 5, such that annular bottom surface 120 of the lid 56 is seated against the shoulder 110, and such that the internal lid wall 140 seals around the spout 80 of the closure body 54.

In order for the lid 56 to move from an open position (e.g., FIG. 7) into the closed position (e.g., FIG. 5), the recessed press portion 58 of the lid 56 flexes laterally inwardly to permit the second latch portion 64 to move axially inwardly past the first latch portion 60 as discussed above. Once the first latch portion 60 of the closure body 54 is retained within the recess 136, the resilient recessed press portion 58 returns laterally outwardly substantially to its as-molded configuration to establish a secure, latched configuration between the closure body 54 and the lid 56.

The detailed operation and function of the closure 40 will next be described with initial reference to FIG. 1. Typically, a user, such as a customer, will encounter the closure 40 as shown in FIG. 1, with the closure 40 installed upon the top end of a container 44 of a fluent substance—the closure 40, container 44, and fluent substance within the container 44 together defining a package.

With reference to FIGS. 3-5, the closure 40 is typically presented to a user with the lid 56 oriented in a non-dispensing, closed position relative to the closure body 54 and the latch portions 60 and 64 (visible in FIG. 5) oriented in a confronting relationship in the latched configuration. The interior wall 140 of the lid 56 seals against, and around, the circumference of the spout 80 to occlude the orifice 84 and prevent leakage of the fluent substance with the lid 56 in the closed position. In the latched configuration, the flat top surface 132 of the second latch portion 64 is somewhat spaced from the bottom surface 106 of the first latch portion 60 and is located in a confronting relationship sufficient to prevent, or at least minimize, the likelihood of the inadvertent opening of the lid 56 during shipping or handling of the package, or from increased pressures that may be developed within the package.

With reference to FIGS. 5 and 6, the user can open the closure 40 by gripping the closure body 54 and/or the container 44 (visible in FIG. 1) and initially pressing with a thumb or finger against the recessed press portion 58 at a location below the projection 124.

With reference to FIG. 6, the user will overcome the inherent stiffness the recessed press portion 58 when a sufficient pre-determined force is applied to the recessed press portion 58 to deflect it laterally inwards a sufficient lateral distance such that the second latch portion 64 clears the first latch portion 60 as shown in FIG. 6. More specifically, the deflection of the press portion 58 moves the recess 136 away from the first latch portion 60 such that the latch portion flat surfaces 106 and 132 are no longer in a confronting relationship. As the user presses against the recessed press portion 58 with the lid 56 in the closed position, (1) the point of rotation of the recessed press portion 58 and the projection 124 are located axially outward of the axis of rotation of the hinge 66, while (2) the first and second latch portions 60 and 64 are located axially inward of the axis of rotation of the hinge 66.

With the reference to FIG. 7, while the user presses the recessed press portion 58 laterally inwardly, the user may subsequently apply an axially outwardly (e.g., upward) force to the lid 56 then to lift the lid 56 to rotate it about the hinge 66 into an open position. The resiliency of the recessed press portion 58 will return it laterally outwardly to its as-molded position as the user decreases the force applied against it. The user may continue to rotate the lid 56 about the hinge 66 a sufficient degree such that the interior cylindrical wall 140 of the lid 56 disengages from around the spout 80 to expose the dispensing orifice 84 (as illustrated in FIGS. 8 and 9).

The user may grasp and squeeze the flexible, resilient container 44 to partially collapse, or otherwise reduce the internal volume of the container 44, to pressurize the fluent substance contained therein. In some situations, the user may also invert the container 44. In any event, during dispensing of the fluent substance, the fluent substance initially enters into the interior volume of the closure body 54, travels through the through passage 76, and exits the closure 40 from the exposed orifice 84.

When the user ceases to squeeze (i.e., pressurize) the container 44, the outward flow of the fluent substance terminates, and the substance may even be sucked back toward the container 44 by a temporary lower pressure within the container 44 (e.g., if the container has resilient walls that return from a "squeezed in" configuration to the normal, nondeformed configuration). This may allow some or all of the residual fluent substance within the spout 80 to be forced by the greater ambient air pressure back through the closure 40 and toward the container 44 to help maintain the overall cleanliness of the package.

Referring to FIGS. 8 and 9, after dispensing a fluent substance through the closure 40, the user may then return the lid 56 to the closed position by rotating the lid 56 about the hinge 66 relative to the closure body 54 such that the lid cylindrical wall 140 re-seals around the spout 80 of the closure body 54.

The first and second latch portions 60 and 64 are advantageously self-actuating as the lid 56 is moved from an open position into the closed position, whereby the user or manufacturer does not need to apply any special force to the lid 56 in addition to the normal lid closing force, or perform any special action to engage the latch portions 60 and 64. The first and second latch portions 60 and 64 are reusable and do not require the user to discard any frangible parts or extra packaging (e.g., adhesive seals, foils, or tapes) while simultaneously securing the lid 56 against a likelihood of inadvertently moving into an open position during transit or handling, or storage at elevated pressures and/or temperatures.

A second embodiment of a closure according to the present invention is illustrated in FIGS. 10-14 and is designated generally by the numeral 40A. The numbered features of the second embodiment of the closure 40A illustrated in FIGS. 10-14 are designated generally with the suffix letter "A" and are analogous to features of the first embodiment of the closure 40 that share the same number (without the suffix letter "A"). As with the first illustrated embodiment of the closure 40, the second embodiment of the closure 40A includes the basic components of a closure body 54A and a lid 56A movably mounted atop the closure body 54A. The closure body 54A is unitarily molded with the lid 56A and connected thereto by a hinge 66A. Similarly, the closure body 54A is provided with a first latch portion 60A and the lid 56A is provided with a recessed press portion 58A having a second latch portion 64A at the distal, cantilevered end thereof. The first and second latch portions 60A and 64A cooperate in a latched configuration to prevent movement of the lid 56A away from a closed position over the closure body 54A. Further, the closure body 54A is provided with a plurality of downwardly-extending walls 90A, the internal surfaces of which define a channel, recess or aperture 94A in the deck 74A, and which is located generally on an opposite side of the closure body 54A with respect to the hinge 66A. The second illustrated embodiment of the closure 40A operates in an identical manner as described in detail above with respect to the first illustrated embodiment of the closure 40, with one notable exception, discussed in detail below, relating to an integral spring-bias feature for biasing the first and second latch portions 60A and 64A together.

Figure 10:
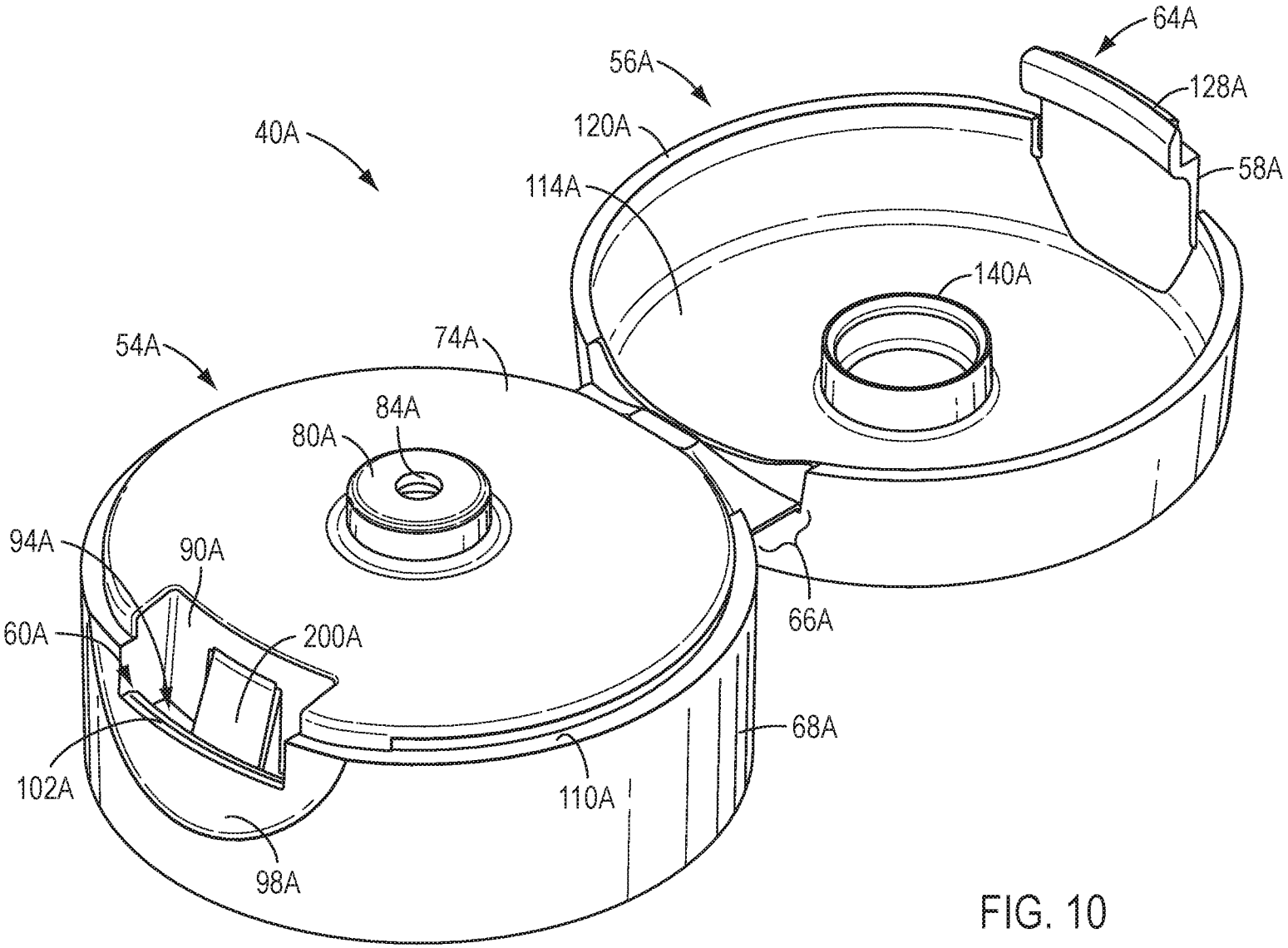
FIG. 10 is a perspective view, taken from above, of a second embodiment of a closure of the present invention shown with the lid oriented in an as-molded, open position.
Figure 11:
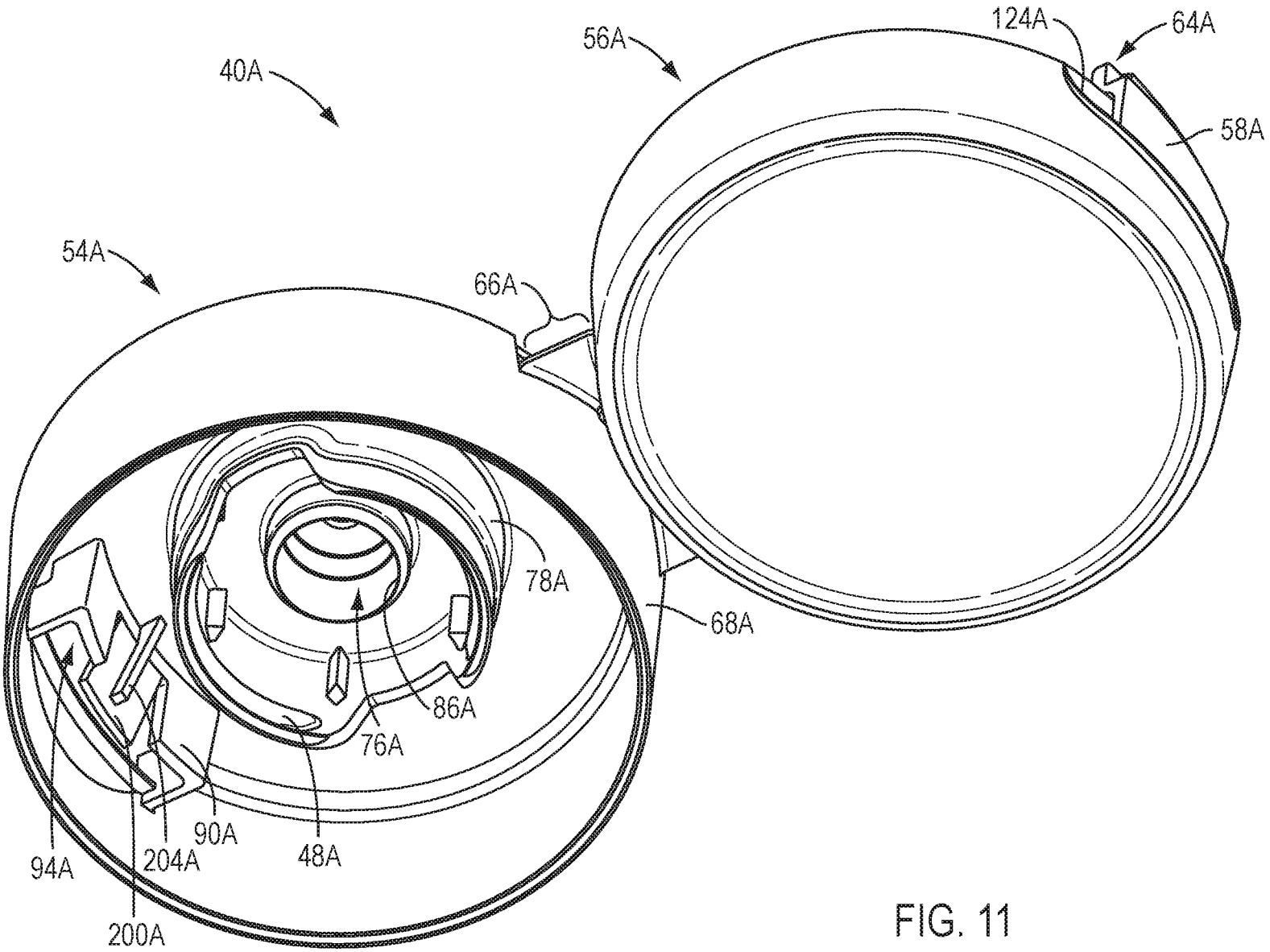
FIG. 11 is a perspective view, taken from below, of the second embodiment of the closure illustrated in FIG. 10.
Figure 12:
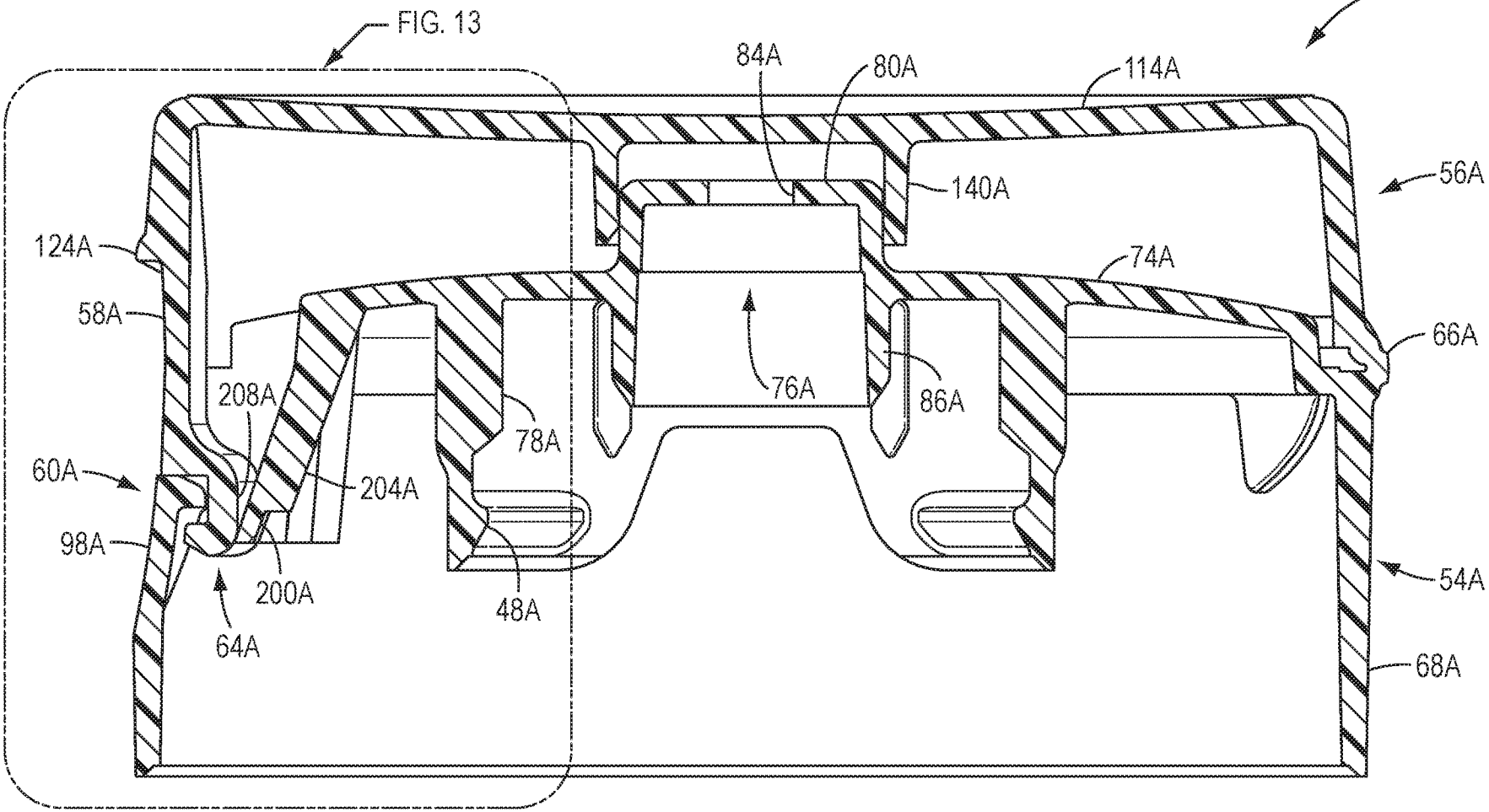
FIG. 12 is a cross-sectional view of the closure illustrated in FIG. 10, taken generally along a vertical plane through the center of the closure.
Figure 13:
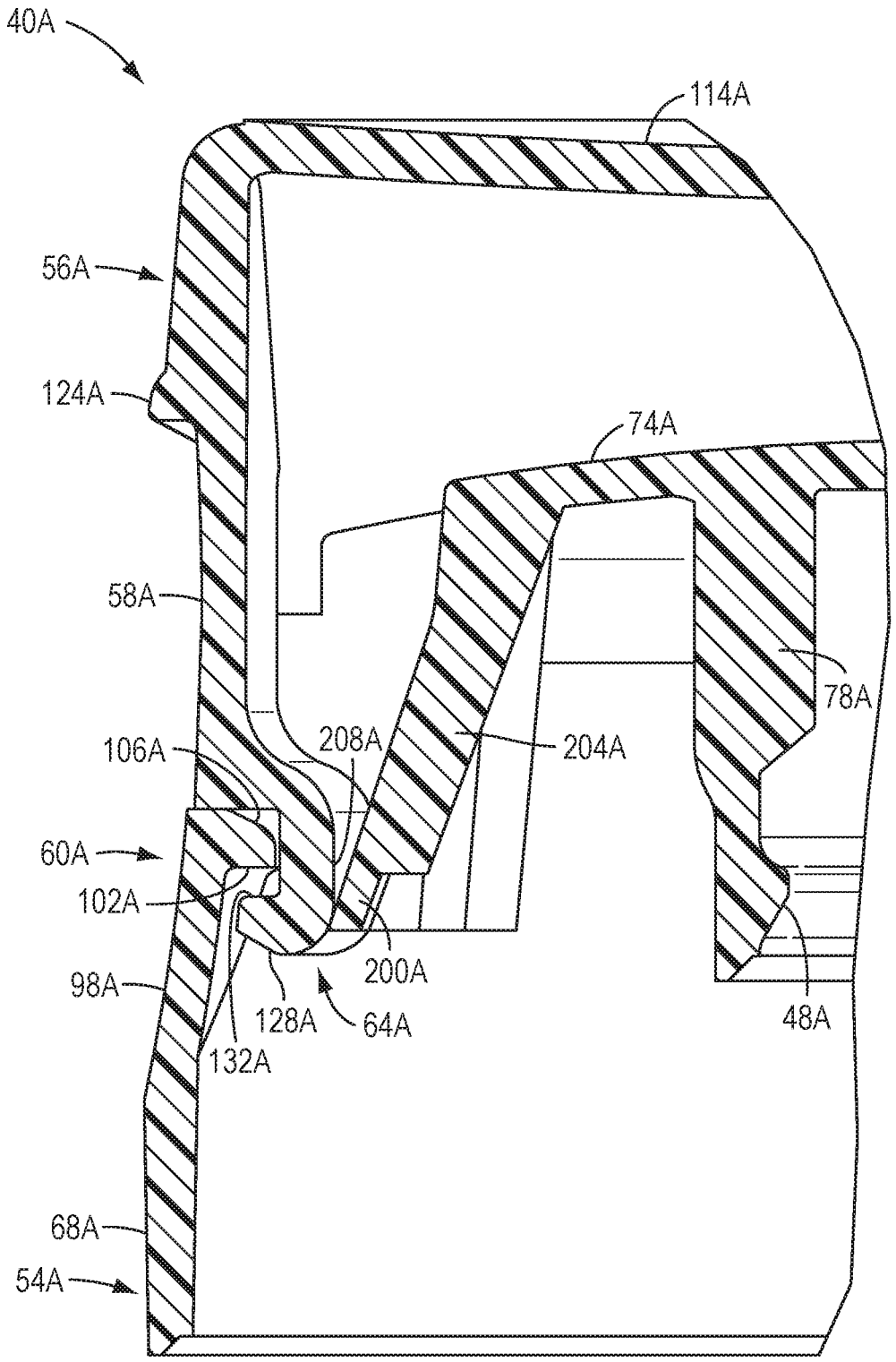
FIG. 13 is a greatly enlarged, fragmentary view of the portion of the closure enclosed in the broken line designated as "FIG. 13" in FIG. 12.
Figure 14:
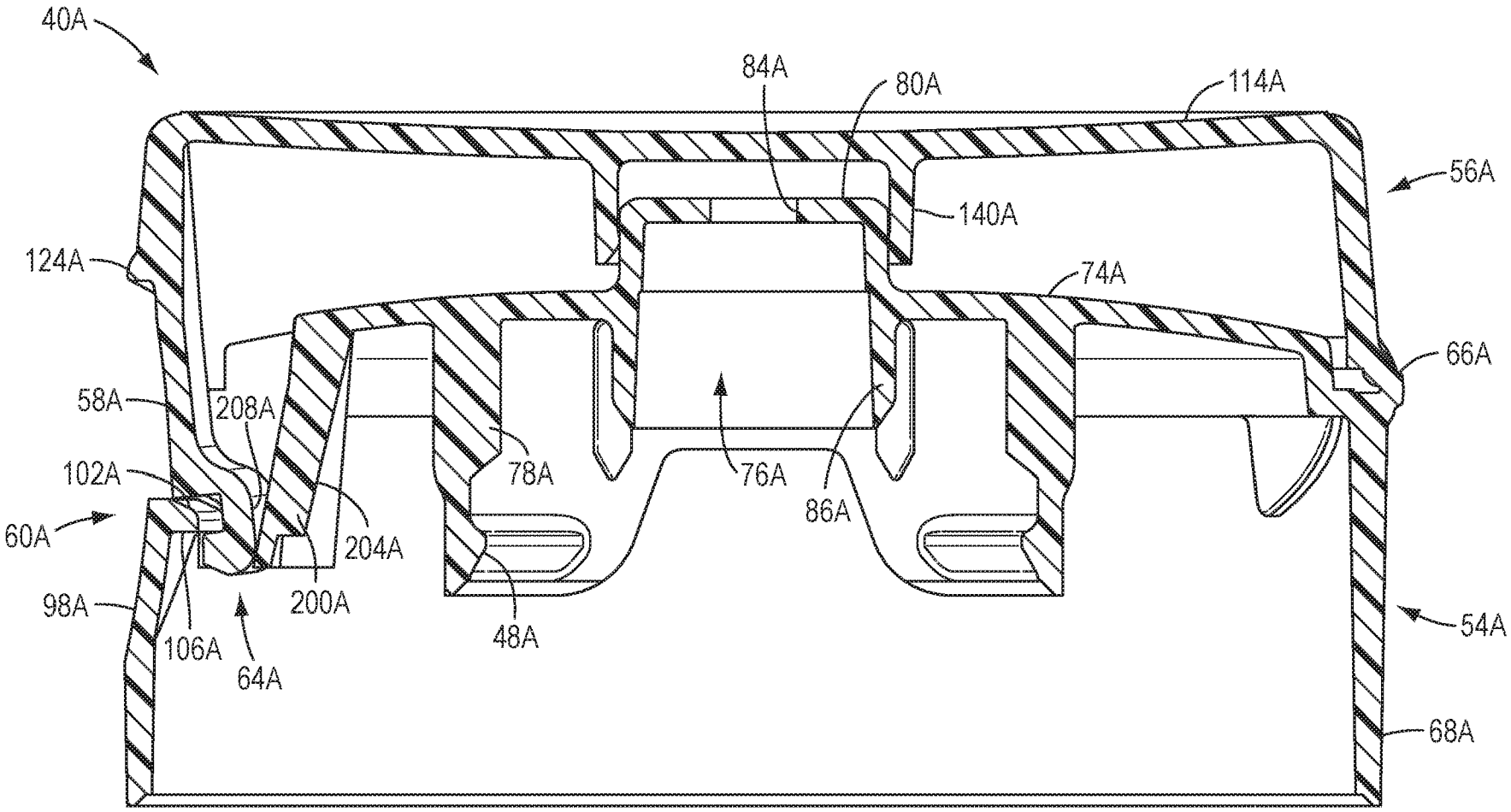
FIG. 14 is a cross-sectional view of the closure that is similar to FIG. 12, except

With reference to FIGS. 10 and 11, the second embodiment of the closure 40A differs from the first embodiment of the closure 40 in that the second embodiment of the closure 40A includes a rectangular, tab-like protrusion or resilient spring member 200A that extends laterally outwardly from the portion of the wall 90A that is opposite of the first latch portion 60A of the closure body 54A. The spring member 200A includes a central reinforcing rib 204A extending along a majority of the length of the spring member 200A (visible in FIG. 11). The spring member 200A has an as-molded configuration that extends into the aperture 94A a sufficient distance to contact and bias the second latch portion 64A of the lid 56A when the lid 56A is closed. As illustrated in FIG. 13, with the lid 56A closed and the lid 56A and closure body 54A in their latched configuration, a distal end of the spring member 200A contacts a back surface 208A of the second latch portion 64A. As illustrated in FIG. 14, when the recessed press portion 58A is pressed laterally inwardly by a user, the back surface 208A of the second latch portion 64A is pressed against the spring member 200A and deflects the spring member 200A laterally inwardly. As with the first illustrated embodiment of the closure 40, the lid 56A of the second illustrated embodiment of the closure 40A may be lifted open by the user with the recessed press portion 58A depressed or deflected sufficiently laterally inwardly to move the second latch portion 64A away from it confronting relationship with the first latch portion 60A.

The inventor has found that the provision of a closure 40A having a spring member 200A to bias the first and second latch portions 60A and 64A together in the latched configuration may be especially advantageous in preventing inadvertent opening of the lid 56A during the shipping and handling of the closure 40A attached to a container of a substance. Depending on the material or materials selected for the resilient press portion 58A, the inherent resiliency of the material or materials may not be sufficient to ensure that the first and second latch portions 60A and 64A maintain their confronting relationship in the latched configuration when the closure 40A is subjected to impact forces or vibrations that may inadvertently urge the lid 56A open. Therefore, the spring member 200A provides an additional resistive force to decrease the likelihood that impact forces or vibrations would inadvertently urge the lid 56A from the closed position to an open position. It will be understood that the size and/or shape of the spring member 200A and the rib 204A, and the material or materials of the closure 40A, may be selected to provide a user-friendly amount of resistance for actuation and opening of the closure 40A. For example, multiple ribs 204A or no rib 204A may be necessary in some applications, depending on the material or materials used.

A third embodiment of a closure according to the present invention is illustrated in FIGS. 15-19 and is designated generally by the numeral 40B. The numbered features of the third embodiment of the closure 40B illustrated in FIGS. 15-19 are designated generally with the suffix letter "B" and are analogous to features of the first embodiment of the closure 40 and the second embodiment of the closure 40A that share the same number (without the suffix letter "B"). As with the first illustrated embodiment of the closure 40, the third embodiment of the closure 40B includes the basic components of a closure body 54B and a lid 56B movably mounted atop the closure body 54B. The closure body 54B is unitarily molded with the lid 56B and connected thereto by a hinge 66B. Similarly, the closure body 54B is provided with a first latch portion 60B and the lid 56B is provided with a recessed press portion 58B having a second latch portion 64B, the first and second latch portions 60B and 64B cooperating in the closure's latched configuration to prevent movement of the lid 56B away from a closed position over the closure body 54B. Further, the closure body 54B is provided with a plurality of downwardly-extending walls 90B, the internal surfaces of which define a channel, recess or aperture 94B in the deck 74B, and the recess 94B is located generally on an opposite side of the closure body 54B from the hinge 66B. The third illustrated embodiment of the closure 40B operates in an identical manner as described in detail above with respect to the first illustrated embodiment of the closure 40, with one notable exception, discussed in detail below, relating to a spring-bias feature for biasing the first and second latch portions 60B and 64B together.

Figure 15:
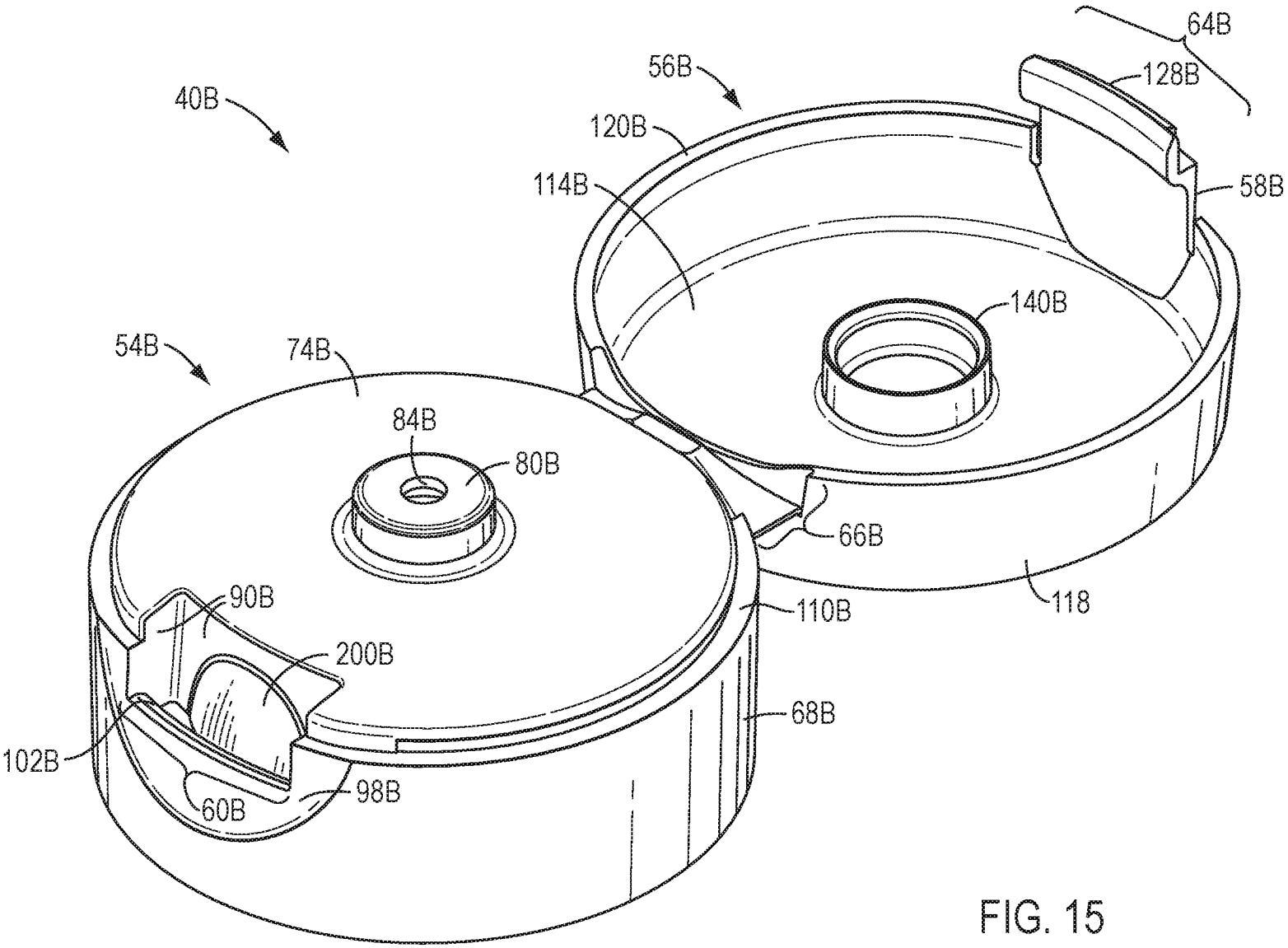
FIG. 15 is a perspective view, taken from above, of a third embodiment of a closure of the present invention shown with the lid oriented in an as-molded, open position.
Figure 16:
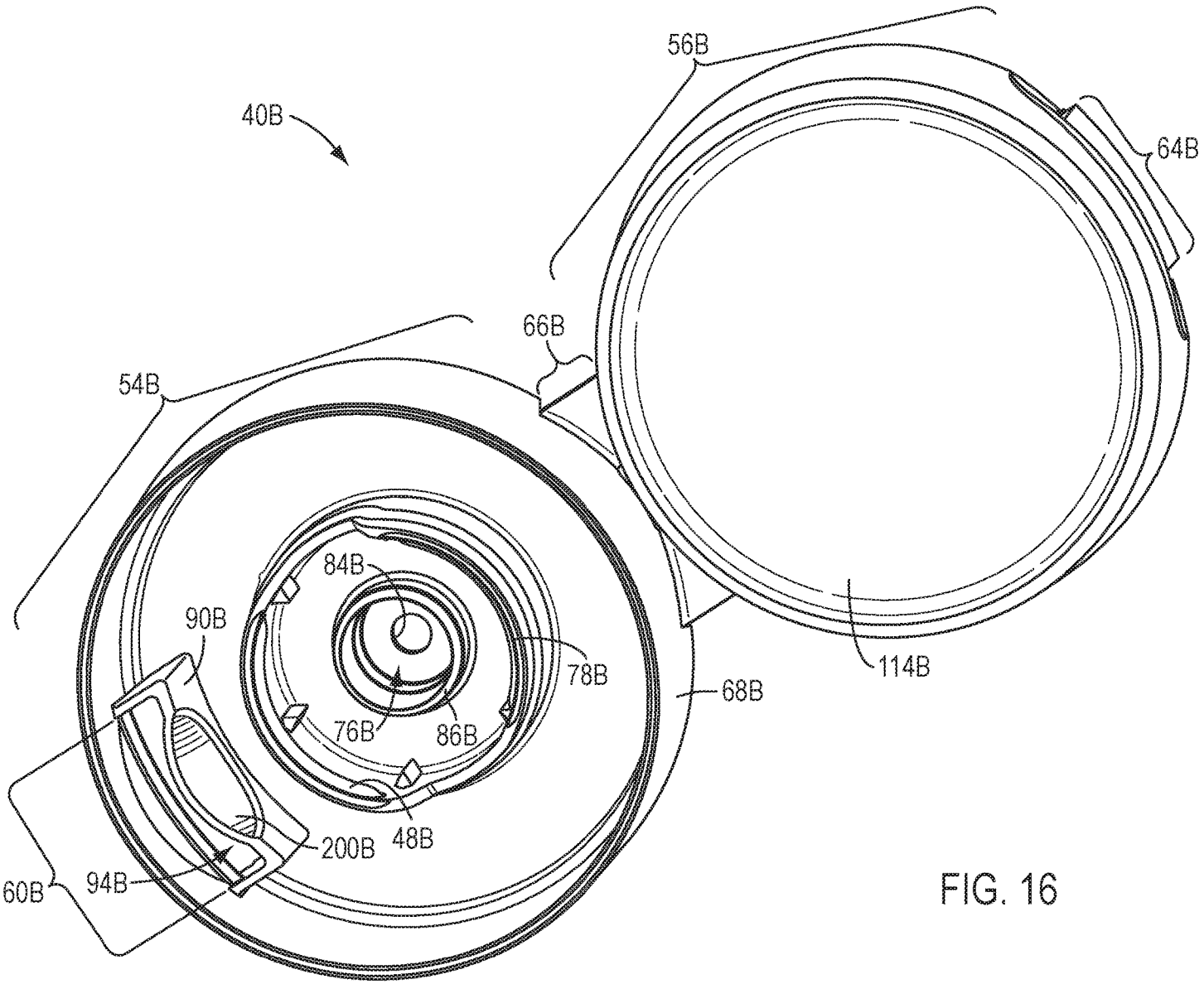
FIG. 16 is a perspective view, taken from below, of the third embodiment of the closure illustrated in FIG. 15.
Figure 17:
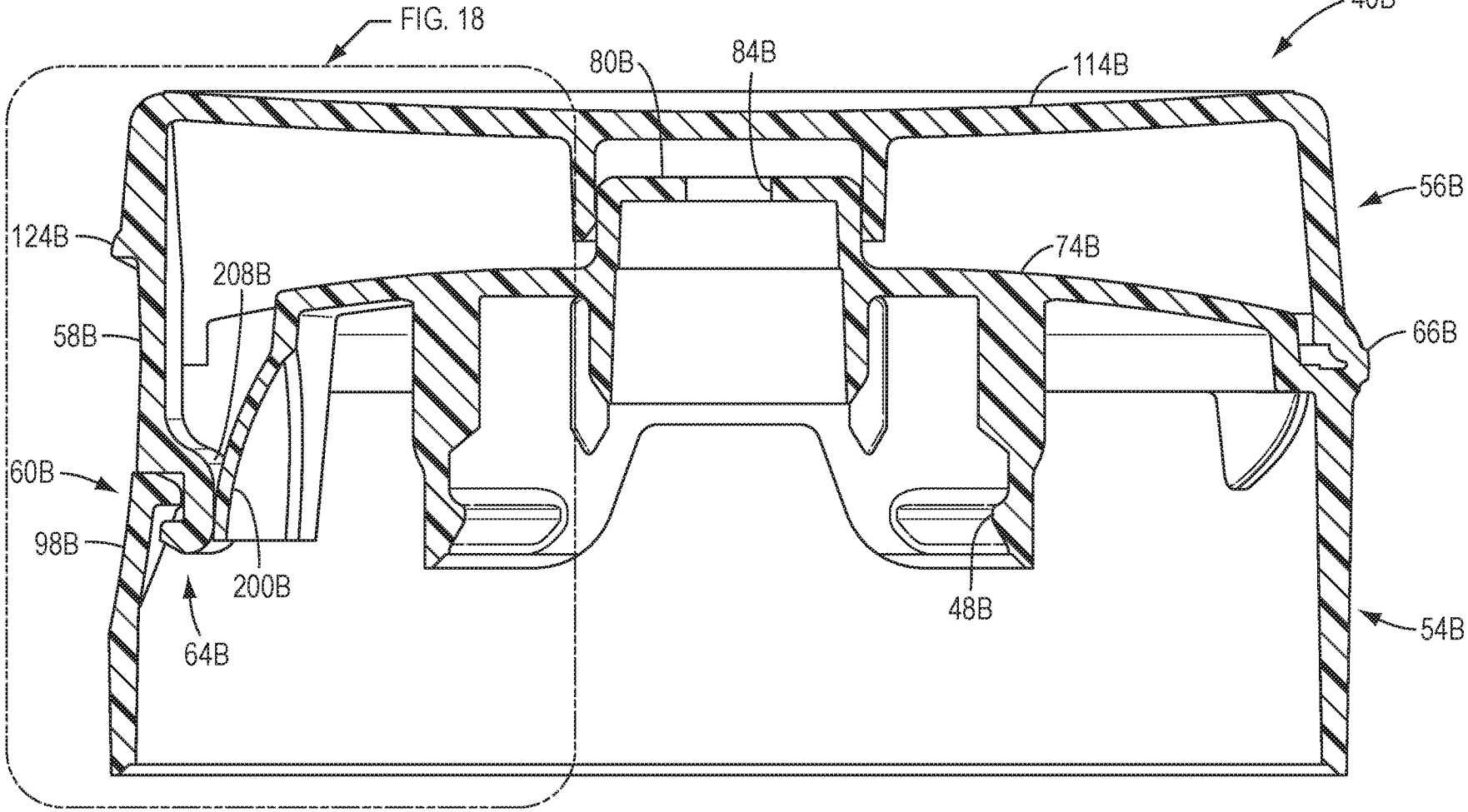
FIG. 17 is a cross-sectional view of the closure illustrated in FIG. 15, taken generally along a vertical plane through the center of the closure.
Figure 18:
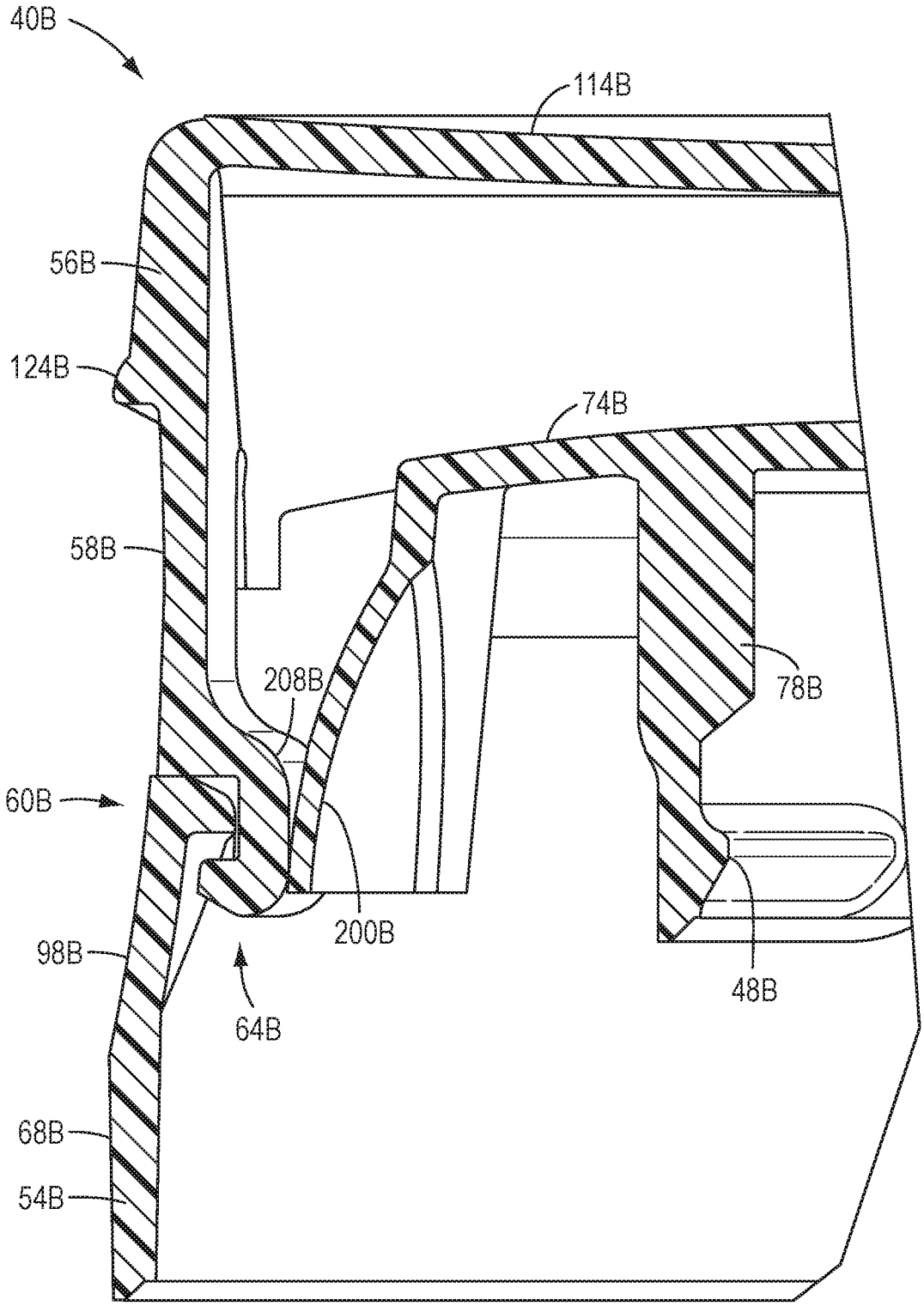
FIG. 18 is a greatly enlarged, fragmentary view of the portion of the closure enclosed in the broken line designated as "FIG. 18" in FIG. 17.

With reference to FIGS. 15 and 18, the third embodiment of the closure 40B includes a partially spherical, dome-like protrusion or spring member 200B that extends laterally outwardly from the portion of one of the walls 90B that is opposite of the first latch portion 60B of the closure body 54B. The spring member 200B has a concave interior side and a convex exterior side facing the first latch portion 60B, as best viewed in FIG. 18. The spring member 200B has an as-molded configuration that extends into the aperture 94B a sufficient distance to contact and bias the second latch portion 64B of the lid 56B laterally outwardly when the lid 56B is located in its closed position.

Figure 19:
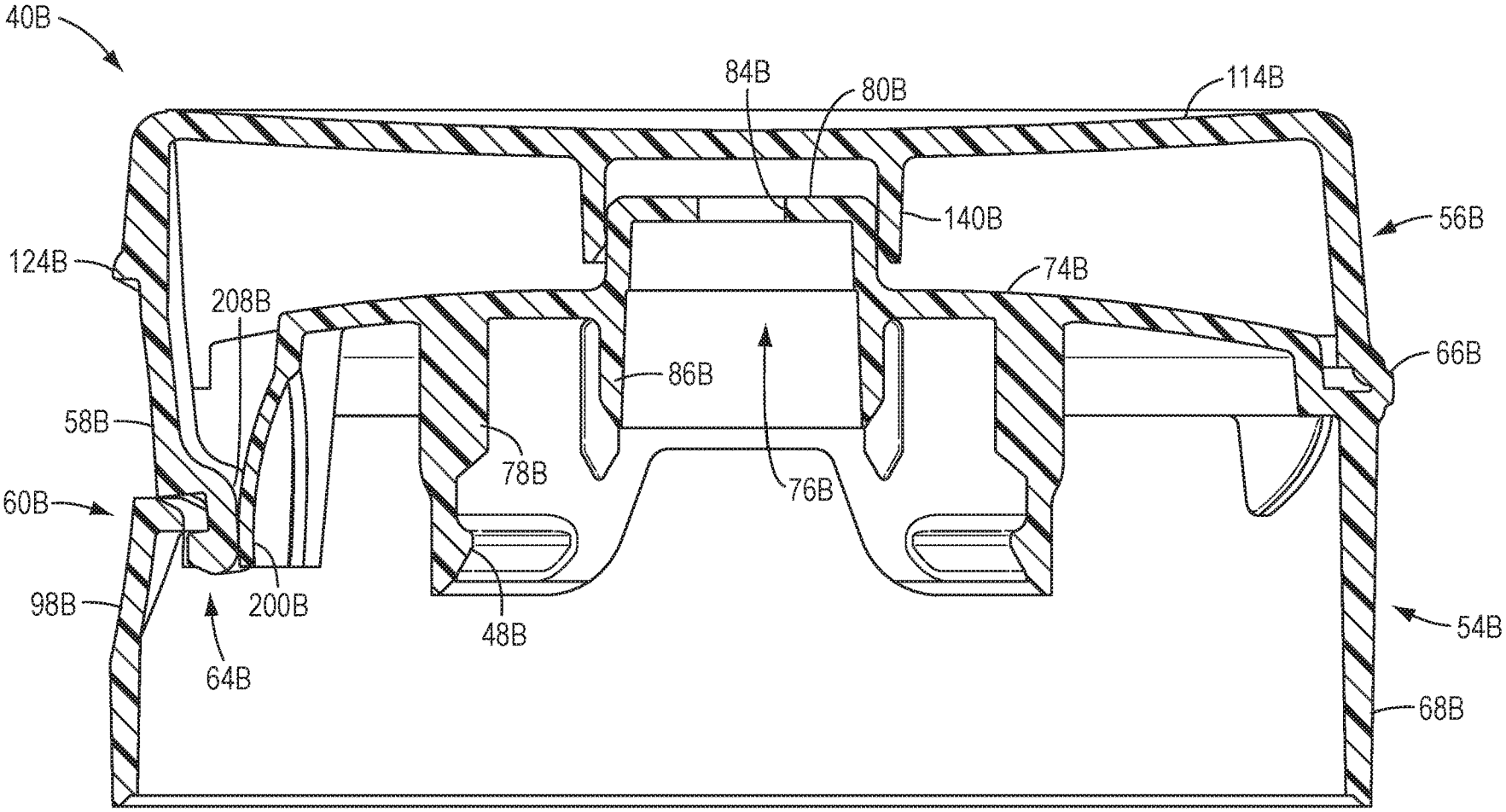
FIG. 19 is a cross-sectional view of the closure that is similar to FIG. 17, except

As illustrated in FIG. 18, with the first and second latch portions 60B and 64B in their confronting relationship in the latched configuration of the lid 56 and the closure body 54, the convex side of the spring member 200B contacts a rear or back surface 208B of the second latch portion 64B. As illustrated in FIG. 19, when the recessed press portion 58B is pressed inwardly by a user, the back surface 208B of the second latch portion 64B of the lid 56B is pressed against, and deflects inwardly, the spring member 200B. As with the first illustrated embodiment of the closure 40, the lid 56B of the third illustrated embodiment of the closure 40B may be lifted open by the user with the recessed press portion 58B depressed or deflected sufficiently laterally inwardly to move the second latch portion 64B out of its confronting relationship with the first latch portion 60B.

The inventor has found that the provision of a closure 40B having dome-like spring member 200B to bias the first and second latch portions 60B and 64B in the latched configuration may be especially advantageous in preventing inadvertent opening of the lid 56B during the shipping and handling of the closure 40B attached to a container of a substance. Depending on the material or materials selected for the resilient press portion 58B, the inherent resiliency of the material or materials may not be sufficient to ensure that the latch portions 60B and 64B maintain the latched configuration when the closure 40B is subjected to impact forces or vibrations that may inadvertently urge the lid 56B open. Therefore, the spring member 200B provides an additional resistive force to decrease the likelihood that impact forces or vibrations would inadvertently urge the lid 56B from the closed position to an open position. It will be understood that the shape and/or size of the spring member 200B, and the material or materials of the closure 40B, may be selected to provide a user-friendly amount of resistance for actuation and opening of the closure 40B. The third embodiment of the closure 40B having a partially spherical spring member 200B may be more easily and economically manufactured as compared to the second embodiment of the closure 40A having a multi-faceted, tab-like spring member 200A.

It will be appreciated that in one alternative embodiment, not illustrated, the recessed press portion may be located on the closure body instead of being located on the lid. The first and second latch portions would be reversed, or otherwise modified, to account for a user's engagement and deflection of a portion of the closure body instead of the lid to effect relative lateral movement of the first and second latch portions. Specifically, in such a design, a user would press against the recessed press portion on the body to deflect it, causing the latch portion at the end of the recessed press portion to move inwardly toward an unlatched configuration relative to the relatively stationary latch portion located on the lid. It will be understood that such an arrangement of the recessed press portion on the closure body, instead of the lid, may require two-handed operation by the user to (1) unlatch the lid from the body, and (2) open the lid, and such two-handed operation may be less advantageous to a user compared to the illustrated embodiments, but may still have the advantage of minimizing the likelihood of the inadvertent opening of the lid during transit (i.e., shipment of the package from the manufacturer to the ultimate end user).

Figure 20:
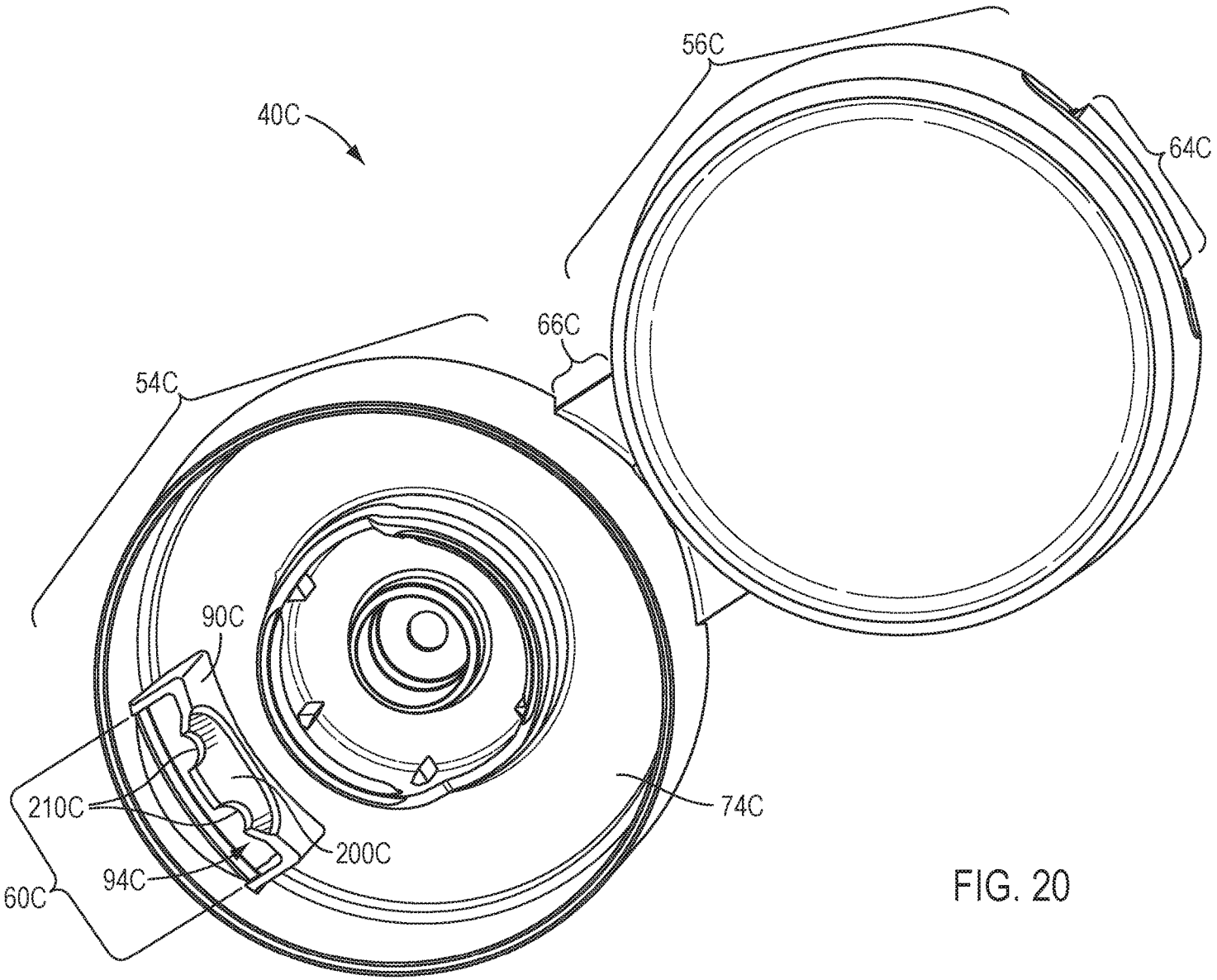
FIG. 20 is a perspective view, taken from below, of a fourth embodiment of a closure of the present invention.

A presently preferred fourth embodiment of a closure according to the present invention is illustrated in FIG. 20 and is designated generally by the numeral 40C. The numbered features of the fourth embodiment of the closure 40C illustrated in FIG. 20 are designated generally with the suffix letter "C" and are analogous to features of the third embodiment of the closure 40B that share the same number (without the suffix letter "B"). As with the third illustrated embodiment of the closure 40B, the fourth embodiment of the closure 40C includes the basic components of a closure body 54C and a lid 56C movably mounted atop the closure body 54C. The closure body 54C is unitarily molded with the lid 56C and connected thereto by a hinge 66C. Similarly, the closure body 54C is provided with a first latch portion 60C and the lid 56C is provided with a recessed press portion 58C having a second latch portion 64C, the first and second latch portions 60C and 64C cooperating in the closure's latched configuration to prevent movement of the lid 56C away from a closed position over the closure body 54C. Further, the closure body 54C is provided with a plurality of downwardly-extending walls 90C, the internal surfaces of which define a channel, recess or aperture 94C in the deck 74C, and the recess 94C is located generally on an opposite side of the closure body 54C from the hinge 66C. The fourth illustrated embodiment of the closure 40C operates in an identical manner as described in detail above with respect to the third illustrated embodiment of the closure 40B, with one notable exception, discussed in detail below, relating to a spring-bias feature for biasing the first and second latch portions 60C and 64C together.

With reference to FIG. 20, the fourth embodiment of the closure 40C includes a partially spherical, dome-like protrusion or spring member 200C that extends laterally outwardly from the portion of one of the walls 90C that is opposite of the first latch portion 60C of the closure body 54C. The spring member 200C has a concave interior side and a convex exterior side facing the first latch portion 60C. The spring member 200C has an as-molded configuration that extends into the aperture 94C a sufficient distance to contact and bias the second latch portion 64C of the lid 56C laterally outwardly when the lid 56C is located in its closed position. The spring member 200C is further provided with a pair of semi-circular cutouts 210C located on either side of the area of contact between the spring member 200C and the second latch portion 64C of the lid 56C when the lid 56C is located in the closed position. The cutouts 210C permit the spring force of the spring member 200C to be decreased or tuned compared to the third embodiment of the closure 40B. It will be understood that the size, shape, and location of the cutouts 210C may be selected depending on the spring force or biasing force required for the particular application.

Figure 21:
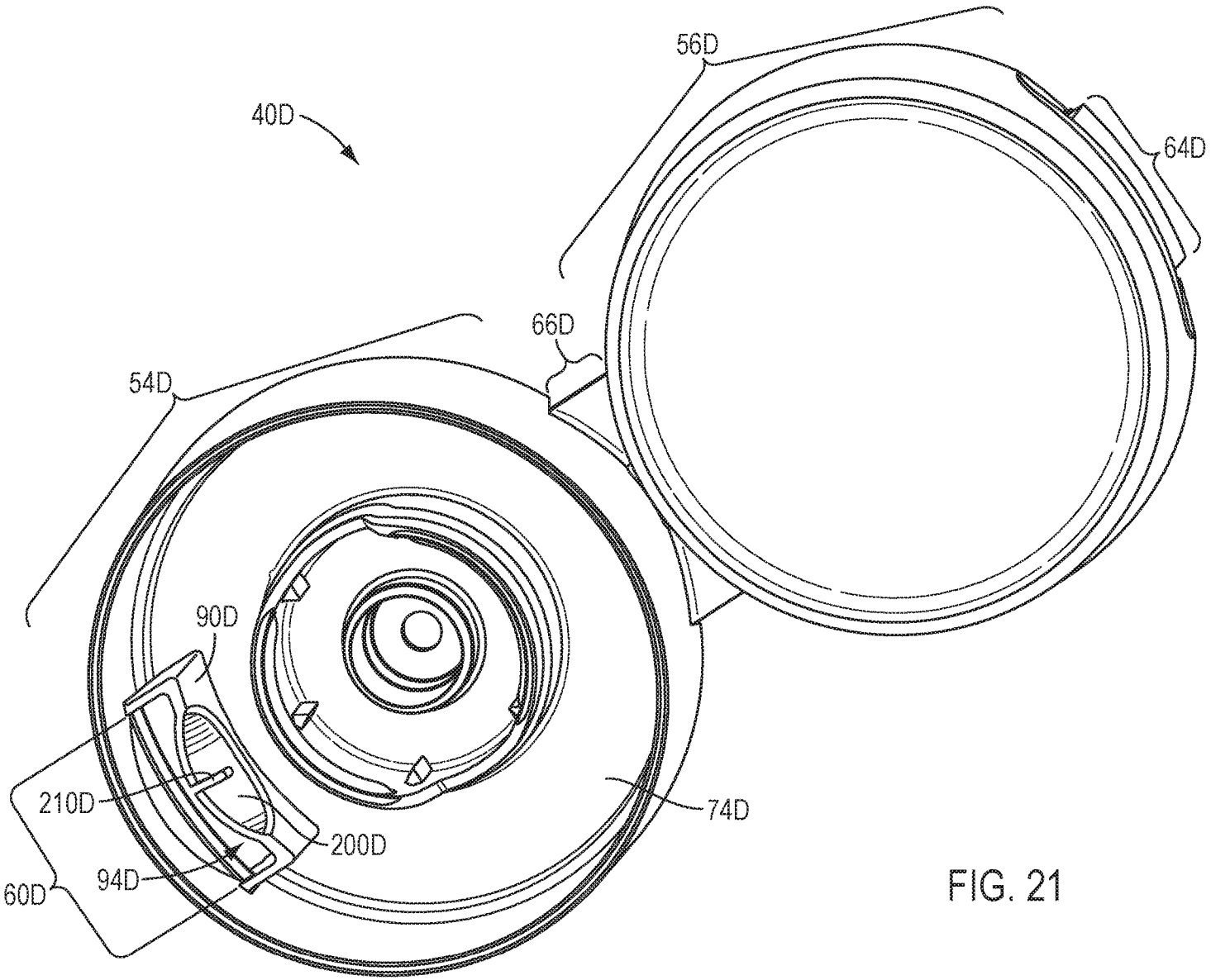
FIG. 21 is a perspective view, taken from below, of a fifth embodiment of a closure of the present invention.

A fifth embodiment of a closure according to the present invention is illustrated in FIG. 21 and is designated generally by the numeral 40D. The numbered features of the fifth embodiment of the closure 40D illustrated in FIG. 21 are designated generally with the suffix letter "D" and are analogous to features of the fourth embodiment of the closure 40C that share the same number (without the suffix letter "C"). As with the fourth illustrated embodiment of the closure 40C, the fifth embodiment of the closure 40D includes the basic components of a closure body 54D and a lid 56D movably mounted atop the closure body 54D. The closure body 54D is unitarily molded with the lid 56D and connected thereto by a hinge 66D. Similarly, the closure body 54D is provided with a first latch portion 60D and the lid 56D is provided with a recessed press portion 58D having a second latch portion 64D, the first and second latch portions 60D and 64D cooperating in the closure's latched configuration to prevent movement of the lid 56D away from a closed position over the closure body 54D. Further, the closure body 54D is provided with a plurality of downwardly-extending walls 90D, the internal surfaces of which define a channel, recess or aperture 94D in the deck 74D, and the recess 94D is located generally on an opposite side of the closure body 54D from the hinge 66D. The fifth illustrated embodiment of the closure 40D operates in an identical manner as described in detail above with respect to the third illustrated embodiment of the closure 40B, with one notable exception, discussed in detail below, relating to a spring-bias feature for biasing the first and second latch portions 60D and 64D together.

With reference to FIG. 21, the fifth embodiment of the closure 40D includes a partially spherical, dome-like protrusion or spring member 200D that extends laterally outwardly from the portion of one of the walls 90D that is opposite of the first latch portion 60D of the closure body 54D. The spring member 200D has a concave interior side and a convex exterior side facing the first latch portion 60D. The spring member 200D has an as-molded configuration that extends into the aperture 94D a sufficient distance to contact and bias the second latch portion 64D of the lid 56D laterally outwardly when the lid 56D is located in its closed position. The spring member 200D is further provided with an elongate central slot or cutout 210D at the area of contact between the spring member 200D and the second latch portion 64D of the lid 56D when the lid 56D is located in the closed position. The cutout 210D permits the spring force of the spring member 200D to be decreased or tuned in a different manner compared to the fourth embodiment of the closure 40C. It will be understood that the length, width, shape, and location of the cutout 210D may be selected depending on the spring force or biasing force required for the particular application.

Various modifications and alterations to this invention will become apparent to those skilled in the art without departing from the scope and spirit of this invention. Illustrative embodiments and examples are provided as examples only and are not intended to limit the scope of the present invention.

What is claimed is:

1. A closure for use with a container having an opening between an exterior of the container and an interior of the container where a substance may be stored, said closure comprising:

A. a closure body that
   1) can be located at the container opening and that defines an inlet portion for communicating with the container,
   2) defines a through passage terminating in an orifice to accommodate the movement of a substance through said closure body, and
   3) defines a first latch portion;

B. a lid that is connected to said closure body and that is movable between (i) a closed position occluding said orifice, and (ii) an open position spaced from said orifice, said lid having a flexible, recessed press portion, said recessed press portion defining a second latch portion; and C. said closure body and said lid having 1) a latched configuration with said lid in said closed position wherein said first latch portion and said second latch portion are oriented in a confronting relationship to prevent said lid from moving into said open position, and 2) an unlatched configuration with said lid in said closed position wherein said recessed press portion is deflected inwardly to orient said second latch portion out of said confronting relationship with said first latch portion to permit said lid to move from said closed position into said open position;

wherein said body further comprises a resilient spring member located laterally inwardly of said first latch portion, said resilient spring member configured to bias said recessed press portion laterally outwardly with said closure body and said lid in said latched configuration;

said body includes a top deck and said resilient spring member projects downwardly and laterally outwardly from said top deck; and said resilient spring member is a generally rectangular tab with a distal end configured to engage said recessed press portion with said closure body and said lid in said latched configuration.

2. The closure in accordance with claim 1 in which said resilient spring member includes a central rib extending along an inner side of said resilient spring member.

3. A closure for use with a container having an opening between an exterior of the container and an interior of the container where a substance may be stored, said closure comprising:

A. a closure body that 1) can be located at the container opening and that defines an inlet portion for communicating with the container, 2) defines a through passage terminating in an orifice to accommodate the movement of a substance through said closure body, and 3) defines a first latch portion;

B. a lid that is connected to said closure body and that is movable between (i) a closed position occluding said orifice, and (ii) an open position spaced from said orifice, said lid having a flexible, recessed press portion, said recessed press portion defining a second latch portion; and C. said closure body and said lid having 1) a latched configuration with said lid in said closed position wherein said first latch portion and said second latch portion are oriented in a confronting relationship to prevent said lid from moving into said open position, and 2) an unlatched configuration with said lid in said closed position wherein said recessed press portion is deflected inwardly to orient said second latch portion out of said confronting relationship with said first latch portion to permit said lid to move from said closed position into said open position;

said body further comprises a resilient spring member located laterally inwardly of said first latch portion, said resilient spring member configured to bias said recessed press portion laterally outwardly with said closure body and said lid in said latched configuration;

said body includes a top deck and said resilient spring member projects downwardly and laterally outwardly from said top deck; and said resilient spring member is a partial dome having a laterally outward, convex side and a laterally inward, concave side, said convex side configured to engage said recessed press portion with said closure body and said lid in said latched configuration.

4. The closure in accordance with claim 3 in which said resilient spring member includes at least one cutout.

* * * * *